US005669038A

United States Patent [19]

Kishimoto

[11] Patent Number: 5,669,038

[45] Date of Patent: Sep. 16, 1997

[54] HEATER CONTROLLING APPARATUS AND A FIXING APPARATUS OF AN ELECTROPHOTOGRAPHIC APPARATUS IN USE THEREWITH

[75] Inventor: Tadao Kishimoto, Hachioji, Japan

[73] Assignee: Konica Corporation, Tokyo, Japan

[21] Appl. No.: 635,326

[22] Filed: Apr. 19, 1996

[30] Foreign Application Priority Data

Apr. 27, 1995 [JP] Japan ..... 7-103578
Sep. 7, 1995 [JP] Japan ..... 7-230225

[51] Int. Cl.[6] ..... G03G 15/20; H05B 1/02

[52] U.S. Cl. ..... 399/67; 219/216; 219/492; 219/497

[58] Field of Search ..... 355/208, 282, 355/285; 219/216, 490, 492, 497; 399/67

[56] References Cited

U.S. PATENT DOCUMENTS 4,374,321 2/1983 Cunningham, Jr. et al. ..... 219/497
4,603,245 7/1986 Yagasaki ..... 219/216
4,627,714 12/1986 Nozaki ..... 355/285
5,079,409 1/1992 Takada et al. ..... 219/497
5,239,164 8/1993 Hirota ..... 219/492
5,367,369 11/1994 Nakai et al. ..... 355/285

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

A fixing unit for printers or copiers includes a heater, in the fixing unit, for heating a fixing member to fix a toner image on a sheet; a zero-cross detector for detecting zero-cross timings of electric power when a voltage of the electric power is at zero volts; a switching circuit for turning on and off the electric power to the heater; a controller for controlling the switching operation of the circuit so as to provide a first state in which the electric power is continuously supplied to the heater for a second state in which the electric power is not supplied to the heater for a multiple of half-cycles from one of the zero cross timings. In the fixing unit, the electric power is supplied to the heater with an intermittent pattern, including the second state, for a predetermined period after at least one of a turn-on operation of the heater and a turn-off operation of the heater.

11 Claims, 18 Drawing Sheets

| COLOR TEMPERATURE | S ( t ) max | Pst |
|---|---|---|
| 2600 K | 28.52 | 1.756 |
| 2400 K | 21.82 | 1.351 |
| 2250 K | 16.552 | 0.934 |
| 2200 K | 15.36 | 0.930 |
| 2000 K | 8.58 | 0.921 |

HEATER CONTROLLING APPARATUS AND A FIXING APPARATUS OF AN ELECTROPHOTOGRAPHIC APPARATUS IN USE THEREWITH

BACKGROUND OF THE INVENTION

The present invention relates to a fixing apparatus which controls power to be supplied to a heater serving as a heat source for fixing used in a copying machine or a printer, and to an electrophotographic apparatus having therein the fixing apparatus mentioned above. It further relates, in particular, to a fixing apparatus and an electrophotographic apparatus which give consideration to flicker caused by a voltage fall that is caused in the surrounding area by an electric current running through a heater.

In general, in an image forming apparatus of an electrophotographic type, image information (original image) of an original is converted to electrical signals (image signals) corresponding to density of the image information, and based on the image signals, an electrostatic latent image is formed by a laser beam or the like on a photoreceptor drum. This electrostatic latent image is developed through development to a toner image which is transferred onto a recording sheet. Then, the toner image on the recording sheet is heated by a heater in a fixing apparatus to be fused and fixed.

As a heater (fixing heater) of the fixing apparatus mentioned above, a heater represented by a halogen lamp or the like is used as a heat source, and such fixing heater is housed in a heat roller.

As a heater of this kind, 100–1000 w fixing heaters are used in a small-sized image forming apparatus, and a fixing heater having a greater wattage is used for those wherein images are formed at high speed.

Incidentally, with regard to the number of heaters, there are various cases including one, two or three heaters.

A fixing heater is controlled so that ON/OFF of power supply to the fixing heater can be controlled in accordance with heater ON signals generated based on results of detection of a temperature sensor arranged in the vicinity of a heat roller and thereby the constant fixing temperature may be maintained.

In the fixing apparatus of this kind, a large rush current flows momentarily at the moment when power supply to a fixing heater changes from OFF to ON.

The foregoing will be explained as follows, referring to FIG. 18. FIG. 18(*a*) shows a voltage waveform of commercial power supply (A.C. 100V) .

At a certain timing, a heater ON signal is changed to the state of ON (FIG. 18(*b*)), and A.C. 100V is supplied to a halogen heater from commercial power supply.

A resistance value of the halogen heater to which no electric current has been supplied up to that moment is extremely low, and its value is about one tenth of the resistance value in the state of red heat, generally.

Accordingly, rush current Γ flows in the halogen heater because the electric current starts flowing for a low resistance value simultaneously with power supply to the halogen heater (FIG. 18(*c*)). Then, as the resistance value rises to the regular value, the heater current falls to I to be converged. Assuming, for example, that the resistance value of the halogen heater being in the state of OFF is one tenth of that in the state of red heat, if heater ON signals are changed to the state of ON when voltage of commercial power supply is high, an electric current which is about ten times greater (Γ=10I) is supposed to flow.

When such rush current Γ is generated, a voltage fall (V1) is caused by electric resistance (impedance) in a receptacle of a commercial power supply that supplies power to an image forming apparatus or in the surrounding thereof or in interior wiring. After that, when the heater current is converged to I, voltage of power supply is slightly restored.

The foregoing will be explained as follows, referring to FIG. 19 which shows a waveform of a peak value of voltage. In this case, the heater is turned ON at the time t1 and rush current is generated, resulting in an outbreak of momentary large voltage fall. After that, the voltage fall is converged to a small value (constant value). Then, the heater is turned OFF at the time of t2, and voltage is returned to its original level.

Since the voltage fall caused by the aforementioned rush current is momentarily great in scale, in particular, it sometimes has an influence even on surrounding equipment and lighting apparatus. For example, when voltage supplied to lighting apparatus is lowered, there sometimes occurs a phenomenon called flicker which means that illuminance is momentarily lowered.

In the case of the foregoing, the heater ON signal was turned ON under the state of high A.C. voltage, and this is why a large rush current flowed. It can be considered therefore that a zero-cross circuit is provided, and that the heater ON signal is turned ON at the timing when power supply voltage is 0V. Owing to this arrangement, it is possible to control a value of rush current to be small because a resistance of the heater rises to a certain extent before the voltage of the heater reaches its peak value.

When such zero-cross control is conducted, the heater ON signal is turned ON at the timing in FIG. 18(*d*), and electric current flows as shown in FIG. 18(*e*). In this case, since the heater ON signal is turned ON at the timing when a peak value of power supply is 0V, the rush current at that timing of ON is smaller than that described before.

Namely, when experiments were made under a certain condition, rush current Γ was about 5I which was a half in terms of value of the rush current described above.

However, rush current that is greater than a regular current still flows, and flicker caused by voltage fall still occurs.

It is therefore considered, for preventing rush current, that two heaters are used to be turned on one by one on a stepwise basis.

However, the method mentioned above requires two systems of control circuits for controlling the two heaters, and a diameter of a fixing roller needs to be sufficient for housing therein two heaters. Therefore, the production cost is increased, which is a problem. In addition, this method can not be applied to a fixing roller designed originally to house one heater.

It is also considered that a resistor or a thermistor is provided in series with a heater, and for a certain period from ON, the heater and the resistor or the thermistor are connected in series to be energized, and then the resistor or the thermistor is cut off and the heater is energized. However, this method has many problems including a problem of heat generated from the heater or other sources, a problem of loss (efficiency drop) caused by the resistor or other sources, and a problem of reliability of circuits for executing connection/cutting off.

For preventing rush current as mentioned above, therefore, there sometimes is used a circuit called a soft starter circuit employing bi-directional and 3-terminal thyristor and conducting continuity angle control.

FIGS. 20(*a*) and 20(*b*) represent time charts showing waveforms in a soft starter circuit of this kind, wherein FIG. 20(*a*) shows waveforms of power supply voltage and FIG. 20(*b*) shows waveforms of a current controlled in terms of continuity angle. Incidentally, indications in this case are based on an assumption that there is no phase difference between voltage and current.

In FIG. 20(*b*), a solid line represents a period of time when the bi-directional and 3-terminal thyristor is actually made to be in the state of continuity. Namely, occurrence of rush current is inhibited when the continuity angle (period of continuity in a half cycle) is increased gradually.

In the case of this soft starter circuit, the rise at the moment of continuity in each cycle shows a sharp waveform as shown in FIG. 20(*b*). Therefore, noise is radiated over a wide frequency range, jamming TV or radio reception. Accordingly, to comply with regulations of noise stipulated as a terminal noise standard, it is necessary to provide a noise filter on a power supply line, which causes a problem of cost increase.

As explained above, occurrence of flicker caused by rush current and a problem of cost for preventing noise are on the relation of a trade-off, and realization of an inexpensive apparatus generating no flicker has been desired.

The present invention has been attained in consideration of the aforementioned problems, and its first object is to realize a heater control device capable of restraining an influence of flicker caused by voltage fall of power supply that results from rush current.

Further, FIG. 21 is a block diagram showing the constitution of power supply lines located in the vicinity of a fixing apparatus in the case of conducting continuity angle control by a thyristor. In FIG. 21, power is supplied from commercial power supply through power plug 11, and noise coming from fixing apparatus 40 is prevented from leaking in commercial power supply by noise filter 20. In this case, the noise filter 20 is composed of common choke 21, X capacitor 22 and Y capacitors 23 and 24. Incidentally, D.C. power supply 30 is a power supply that supplies prescribed D.C. voltage to each section in an apparatus (unillustrated process means such as a charging means, a developing means and a transfer section).

For example, in the constitution shown in FIG. 21, electric current of about 8–10 A flows to fixing apparatus 40 which includes heater 41, and that of about 1–2 A flows to D.C. power supply 30. Therefore, noise filter 20 is also constituted to be a large filter that withstands large current of about 12 A. In particular, a common choke is unavoidably required to be large in size, which leads to a large-sized apparatus.

In particular, when odd-number-order harmonic current generated in D.C. power supply 30 and that generated from fixing apparatus 40 are superposed, it sometimes happens that a level of noise generated from an entire apparatus exceeds a range of the noise standard even when each of the aforesaid D.C. power supply and fixing apparatus.

Here, the odd-number-order harmonic current generated in D.C. power supply 30 will be explained briefly. The D.C. power supply 30 is of a circuit structure shown in FIG. 22, for example, wherein an electric current rectified by diode bridge 31 charges electrolytic capacitor 32, then switching is made by SW element 33, and necessary voltage is outputted from SW transformer 34.

In this case, current i from a commercial power supply flows in the state of pulses only when voltage V nears V0, because the electrolytic capacitor 32 is charged almost to peak voltage V0. Since this current waveform (see FIG. 23) is symmetrical in terms of positive and negative sides, it is understood that Fourier spectrum takes only odd-number-order harmonic.

For the reason mentioned above, it is unavoidable that a common choke be made large, which is a problem.

The present invention has been achieved in consideration of the foregoing, and its second object is to realize a fixing apparatus or an electrophotographic apparatus which employs a halogen lamp heater as a heat source and which is capable of overcoming the problems of flicker and noise by a simple circuit arrangement without controlling a continuity angle.

SUMMARY OF THE INVENTION

Namely, an example attaining the first object mentioned above is represented by the embodiments described in the following items (1) and (2).

(1) A heater controlling apparatus supplying A.C. power supply to a heater in accordance with heater ON signals, wherein there are provided a zero-cross detecting circuit that detects the zero-cross timing of a power supply phase, a drive pulse generating circuit that receives heater ON signal from outside to cause A.C. half-wave drive to be performed immediately after heater ON, then generates half-wave drive signals and full-wave drive signals for the purpose of causing A.C. full-wave drive to be performed after a certain period of time and generates and outputs selectively half-wave drive pulses corresponding to half-wave drive signals and full-wave drive pulses corresponding to full-wave drive signals in the detected zero-cross timing, and a switching means that supplies power supply to a heater through the half-wave drive pulses and full-wave drive pulses from the drive pulse generating circuit by switching between A.C. half-wave drive and A.C. full-wave drive.

(2) A heater controlling apparatus supplying A.C. power supply to a heater in accordance with heater ON signals, wherein there are provided a zero-cross detecting circuit that detects the zero-cross timing of a power supply phase, a drive pulse generating circuit that receives heater ON signal from outside to cause A.C. half-wave drive to be performed immediately after heater ON, then generates half-wave drive signals and full-wave drive signals for the purpose of causing A.C. full-wave drive to be performed after a certain period of time and causing A.C. half-wave drive to be performed in the case of heater OFF, and generates and outputs selectively half-wave drive pulses corresponding to half-wave drive signals and full-wave drive pulses corresponding to full-wave drive signals in the detected zero-cross timing, and a switching means that supplies power supply to a heater through the half-wave drive pulses and full-wave drive pulses from the drive pulse generating circuit by switching between A.C. half-wave drive and A.C. full-wave drive.

In the example in the above item (1), half-wave drive pulses and full-wave drive pulses are generated in accordance with heater ON signals coming from the outside, and thereby, the switching means supplies power supply to a heater through switching between A.C. half-wave drive and A.C. full-wave drive. In this case, the A.C. half-wave drive is performed immediately after heater ON, while the A.C. full-wave drive is performed after a certain period of time.

When performing the drive mentioned above, the half-wave drive conducted under the commercial power supply frequency which is hardly sensitive to human eyes makes a person to feel as if the voltage fall is lessened to half, thus, flicker is reduced, though a peak value of rush current and a peak value of voltage fall therefrom are the same as those in the conventional zero-cross method.

In the example in the above item (2), half-wave drive pulses and full-wave drive pulses are generated in accordance with heater ON signals coming from the outside, and thereby, the switching means supplies power supply to a heater through switching between A.C. half-wave drive and A.C. full-wave drive. In this case, the A.C. half-wave drive is performed immediately after heater ON, then, the A.C. full-wave drive is performed after a certain period of time, and A.C. half-wave drive is performed in the case of heater OFF.

When performing the drive mentioned above, the half-wave drive conducted under the commercial power supply frequency which is hardly sensitive to human eyes makes a person to feel as if the voltage fall is lessened to half, thus, flicker is reduced, though a peak value of rush current in the case of heater ON and a peak value of voltage rise in the case of heater OFF are the same as those in the conventional zero-cross method.

Namely, an example attaining the second object mentioned above is represented by the embodiments in the following items (3) through (12).

(3) A fixing apparatus supplying A.C. power to a heater serving as a heat source for fixing in accordance with heater ON signals, wherein there are provided a zero-cross detecting circuit that detects the zero-cross timing of a power supply phase, a drive pulse generating circuit that generates intermittent drive signals and full-wave continuous drive signals so that zero-cross lighting is made for a prescribed period of time by an A.C. intermittent pattern which makes power to be smaller than rated energizing power in A.C. continuous lighting from at least ON timing among ON timing and OFF timing of a heater and that A.C. full-wave continuous drive is conducted after the prescribed period of time and generates selectively and outputs intermittent drive pulses corresponding to intermittent drive signals and full-wave drive pulses corresponding to full-wave continuous drive signals at the detected zero-cross timing, and a switching means that supplies power to a heater by switching between intermittent drive and continuous drive by means of intermittent drive pulses and full-wave drive pulses from the drive pulse generating circuit.

In the example in the above item (3), power is supplied to the heater on a basis of zero-cross lighting of intermittent drive pattern, through switching made by a switching means in accordance with heater ON signals from the outside. Due to this intermittent drive pattern, the power which is smaller than rated energizing power is supplied, and after the prescribed period of time, the rated power on a basis of A.C. continuous lighting is supplied to the heater.

When zero-cross lighting on an A.C. intermittent pattern is conducted during a prescribed period of time from at least ON timing, it is possible to reduce flicker component of a prescribed frequency to which a person is sensitive. Further, switching noise is hardly made because of the zero-cross control instead of continuity angle control.

(4) In the example in the above item (3), when an A.C. intermittent pattern based on intermittent drive pulse generated from a drive pulse generating circuit is represented by a pattern wherein any one of the following items is repeated, it is preferable for reducing the flicker.

(1) Only a half cycle among A.C. one cycle is used for energizing.

(2) Only one or two half-cycles among A.C. 1.5 cycles are used for energizing.

(3) Only 1–3 half-cycles among A.C. two cycles are used for energizing.

(4) Only 1–4 half-cycles among A.C. 2.5 cycles are used for energizing.

(5) Only 1–5 half-cycles among A.C. 3 cycles are used for energizing.

(6) Only 2 half-cycles with the same polarity among A.C. 3 cycles are used for energizing.

The drive on a basis of the A.C. intermittent pattern mentioned above makes the flicker frequency to be (1) 50 Hz, (2) 33 Hz, (3) 25 Hz, (4) 20 Hz and (5) and (6) 16.6 Hz, thus, it is possible to reduce the component of 8.8 Hz flicker which is easily sensed by a person.

(5) In the example in the above item (3), it is preferable, from the viewpoint of reducing flicker, to use, as a heat source for fixing, a heater whose color temperature is 2600° k or lower.

When there is used a heater having the color temperature of 2600° k or lower as stated, a ratio of a resistance value in lights-out (low temperature) to that in lighting (high temperature) is smaller despite the same wattage, compared with an occasion where a heater having the color temperature of 2600° k or higher is used. As a result, rush current is lowered which leads to the reduction of flicker.

(6) An electrophotographic apparatus in which A.C. power is supplied, in accordance with heater ON signals, to a heater serving as a heat source for fixing, wherein there are provided a D.C. power supply section where input current waveform is non-sine-wave, and a switching means that supplies power to the heater for conducting zero-cross lighting with an A.C. intermittent pattern so that the power may be smaller, for at least a prescribed period of time from at least ON timing of ON timing and OFF timing of the heater, than rated energizing power with A.C. continuous lighting.

In the example in the above item (6), power is supplied to the heater on a basis of zero-cross lighting of intermittent drive pattern, through switching made by a switching means in accordance with heater ON signals from the outside. Due to this A.C. intermittent pattern, the power which is smaller than rated energizing power is supplied, and after the prescribed period of time, the rated power on the basis of A.C. continuous lighting is supplied to the heater.

When zero-cross lighting on an A.C. intermittent pattern is conducted during a prescribed period of time from ON timing at least, it is possible to reduce flicker component of a prescribed frequency that is sensitive to a person. Further, switching noise is hardly made because of the zero-cross control instead of continuity angle control.

(7) In the example in the above items (5) or (6), it is preferable, for reduction of flicker and noise, that the A.C. intermittent pattern is a half-wave drive pattern having a fixed polarity.

The A.C. half-wave drive mentioned above makes the flicker frequency to be 50 Hz, thus, it is possible to reduce the component of 8.8 Hz flicker which is easily sensed by a person. Further, a harmonic contained in an electric current that flows in the course of A.C. half-wave drive is an even-number-order harmonic, its number of order is different from that for the odd-number-order harmonic of D.C. power supply section. Therefore, with regard to each harmonic, even it is the maximum value in the noise standard, it is allowed.

(8) In the example in the above item (7), when a half-wave drive pattern with one fixed polarity of the aforesaid switching means is represented by a pattern wherein any one of the following items is repeated, it is preferable for reducing the flicker and noise.

(1) A half cycle among A.C. one cycle is used for energizing.
(2) A half cycle among A.C. two cycles is used for energizing.
(3) A half cycle among A.C. three cycles is used for energizing.
(4) Two half cycles having the same polarity among A.C. three cycles are used for energizing.

The A.C. half-wave drive mentioned above makes the flicker frequency to be (1) 50 Hz, (2) 25 Hz, and (3) 16.6 Hz, thus, it is possible to reduce the component of 8.8 Hz flicker which is easily sensed by a person.

Further, a harmonic contained in an electric current that flows in the course of A.C. half-wave drive is an even-number-order harmonic, its number of order is different from that for the odd-number-order harmonic of D.C. power supply section. Therefore, with regard to each harmonic, even it is the maximum value in the noise standard, it is allowed.

(9) In the example in the above item (6), it is preferable, from the viewpoint of reducing flicker, to use, as a heat source for fixing, a heater whose color temperature is 2600° k or lower.

When there is used a heater having the color temperature of 2600° k or lower as stated, a ratio of a resistance value in lights-out (low temperature) to that in lighting (high temperature) is smaller despite the same wattage, compared with an occasion where a heater having the color temperature of 2600° k or higher is used. As a result, rush current is lowered which leads to the reduction of flicker.

(10) An electrophotographic apparatus in which A.C. power is supplied, in accordance with heater ON signals, to a heater, wherein there are provided a switching regulator serving as a D.C. power supply section and a switching means that supplies power to the heater for conducting zero-cross lighting with A.C. intermittent pattern so that the power may be smaller, for at least a prescribed period of time from at least ON timing of ON timing and OFF timing of the heater, than rated energizing power with A.C. continuous lighting, and further a common choke for reducing noise is provided only on the side of a line through which an electric current flows from the commercial power supply to the switching regulator.

In the example in the above item (10), power is supplied, in accordance with heater ON signals from the outside, to the heater with zero-cross lighting of an A.C. intermittent pattern through switching by means of a switching means. Due to this A.C. intermittent pattern, power which is smaller than the rated energizing power is supplied to the heater, and after a prescribed period of time, the rated power based on A.C. continuous lighting is supplied to the heater. When zero-cross lighting of an A.C. intermittent pattern is conducted for a predetermined period of time from at least ON timing as mentioned above, it is possible to reduce flicker component of a certain frequency that is easily sensed by a person. In addition, switching noise is hardly generated because zero-cross control is conducted instead of continuity angle control. Therefore, a common choke for reducing noise has only to be provided on the side of the D.C. power supply section. Accordingly, less electric current flows through the common choke, which makes it possible to use a small-sized choke having fine wire. Owing to this, it is possible to realize a small-sized apparatus.

(11) In the example in the above item (10), when an A.C. intermittent pattern of a switching means is represented by a pattern wherein any one of the following items is repeated, it is preferable for reducing the flicker.

(1) Only a half cycle among A.C. one cycle is used for energizing.
(2) Only one or two half-cycles among A.C. 1.5 cycles are used for energizing.
(3) Only 1–3 half-cycles among A.C. two cycle are used for energizing.
(4) Only 1–4 half-cycles among A.C. 2.5 cycles are used for energizing.
(5) Only 1–5 half-cycles among A.C. 3 cycles are used for energizing.
(6) Only 2 half-cycles with the same polarity among A.C. 3 cycles are used for energizing.

The A.C. intermittent pattern drive mentioned above makes the flicker frequency to be (1) 50 Hz, (2) 33 Hz, and (3) 25 Hz, (4) 20 Hz, and (5) and (6) 16.6 Hz, thus, it is possible to reduce the component of 8.8 Hz flicker which is easily sensed by a person.

Incidentally, variations other than the lighting patterns mentioned above can also be considered. Namely, there are available various kinds of patterns to combine ON and OFF. Even a pattern which is not cyclic can be used. However, the greater the cycle is, the smaller the effect is, because the greater cycle nears 8.8 Hz which can be sensed by a person.

(12) The invention is represented by a fixing apparatus that is provided with a heater that is composed of a halogen lamp of 500 W or more serving as a heat source for fixing and has a color temperature of not more than 2200° k and with a power supply means that supplies A.C. power to the heater in accordance with heater ON signals.

When the color temperature is 2200° k, it is possible to control the flicker to be small enough even in the case of a heater having only one halogen lamp of 500 W or more.

DETAILED DESCRIPTION OF THE INVENTION

Figure 1:
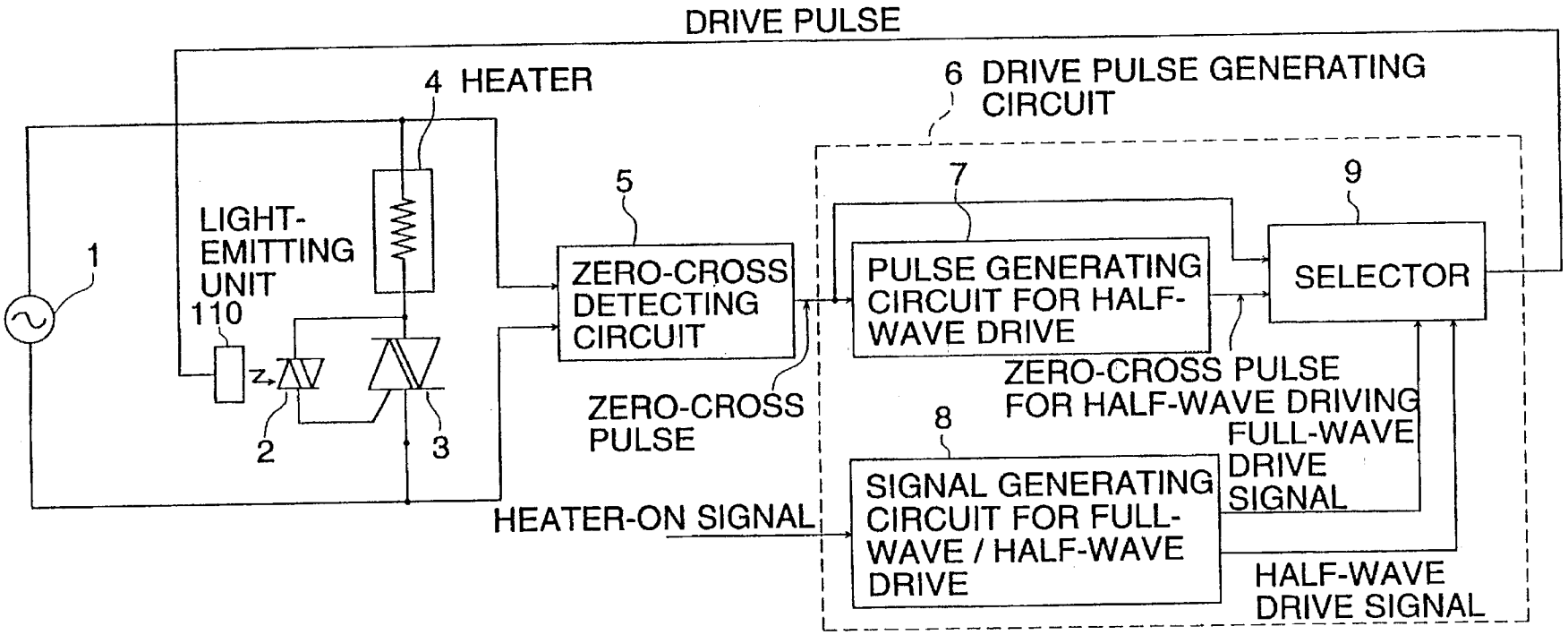
FIG. 1 is a structural diagram showing the constitution of a heater controlling apparatus that is an example of the invention.

The examples in (1) and (2) mentioned above will be explained in detail as follows, referring to the drawings.

Figure 2:
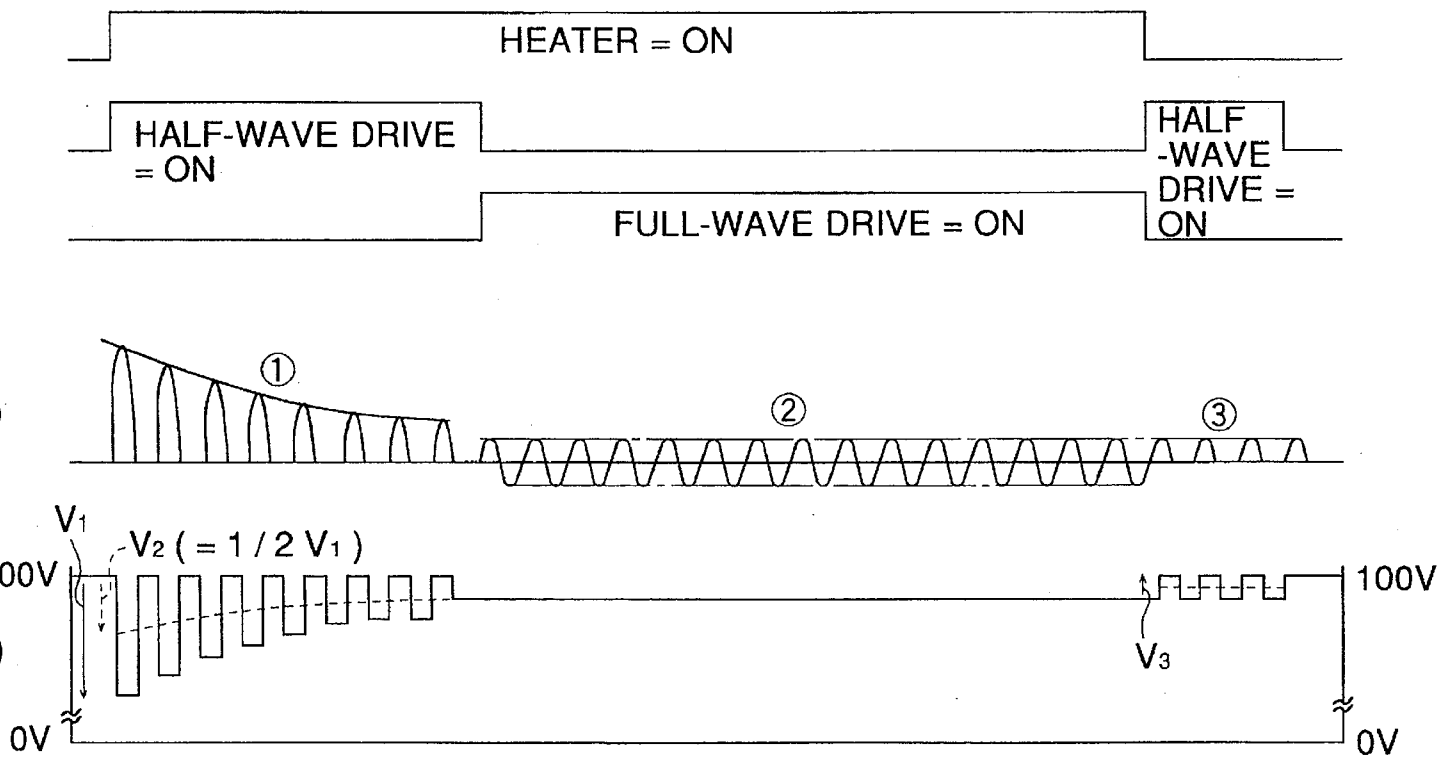
FIGS. 2(*a*)–2(*e*) are time charts showing operations of the heater controlling apparatus that is an example of the invention.

FIG. 1 is a block diagram showing the constitution of an heater controlling apparatus that is an example of the invention. FIGS. 2(*a*)–2(*e*); and thereafter represent a time chart for explaining operations of the present examples.

Constitution of a heater controlling apparatus

FIG. 1 shows schematic constitution of an heater controlling apparatus that is an example of the invention. In FIG. 1, power supply 1 represents the power supply that is a base for supplying power to a heater controlling apparatus, and FIG. 1 shows an occasion wherein an A.C. (50 Hz or 60 Hz) commercial power supply is used as is. Incidentally, without being limited to commercial power supply, the power supply such as an independent power plant having the similar frequency can also be employed.

Photo-thyristor 2 is a thyristor which is turned on by light projected thereto, and it triggers bi-directional and 3-terminal thyristor 3 which is described later.

The bi-directional and 3-terminal thyristor 3 is a switching element that is triggered by the photo-thyristor 2 and is used after being switched between half-wave rectification and full-wave rectification.

Heater 4 is a halogen heater for a fixing apparatus and it is subjected to current control by the bi-directional and 3-terminal thyristor 3.

Zero-cross detecting circuit 5 is a circuit that detects zero-cross timing of voltage of power supply 1, and it outputs pulses (zero-cross pulses) at the zero-cross timing.

Pulse generating circuit for half-wave drive 7 receives zero-cross pulses from the zero-cross detecting circuit 5, and outputs only pulses of zero-cross timing in the fixed direction, for the half-wave drive. Signal generating circuit for full-wave/half-wave drive 8 is a circuit that receives heater ON signals and generates drive signals (full-wave drive signals and half-wave drive signals) which are for switching between full-wave drive and half-wave drive at a predetermined timing, and its output is supplied to selector 9. The selector 9 receives zero-cross pulses, zero-cross pulses for half-wave drive, and signals for full-wave/half-wave drive, and generates pulses (drive pulses) for driving photo-thyristor 2.

Incidentally, it is assumed that the pulse generating circuit for half-wave drive 7 signal generating circuit for full-wave/half-wave drive 8 and selector 9 are collectively called drive pulse generating circuit 6.

Light-emitting section 10 is one that receives drive pulses and emits light for driving a photo-thyristor, and it is provided in the vicinity of a light-receiving section inside the photo-thyristor 2.

Operations of a heater controlling apparatus

Operations of a heater controlling apparatus constituted as in the foregoing will be explained as follows.

When heater controlling signals are turned ON as a result of detection of an unillustrated temperature detecting circuit, the signal generating circuit for full-wave/half-wave drive 8 generates half-wave drive signals immediately after ON, full-wave drive signals after a certain period of time of A.C. half-wave drive and half-wave drive signals after at the moment of OFF.

FIG. 2(*a*) shows heater ON signals, and the half-waved drive signals are caused to be on the state of ON immediately after the change to ON (FIG. 2(*b*)),and the full-wave drive signals are caused to be on the state of ON after a certain period of time (FIG. 2(*c*)). Immediately after the heater ON signals are changed to OFF, the half-wave drive signals are caused to be on the state of ON again for a certain period of time (FIG. 2(*b*)).

Let a certain period immediately after a change of heater ON signals to ON be considered.

The selector 9 which has received the half-wave drive signals mentioned above supplies zero-cross pulses for half-wave drive to light-emitting section 10 as drive pulses during the period of receiving the half-wave drive signals. Therefore, a photo-thyristor which has received light from the light-emitting section 10 is triggered only for a period of the half-wave to be on the state of continuity, and bi-directional and 3-terminal thyristor 3 is also caused to be on the state of continuity (half-wave rectification state) only for a period of half-wave.

Figure 18:
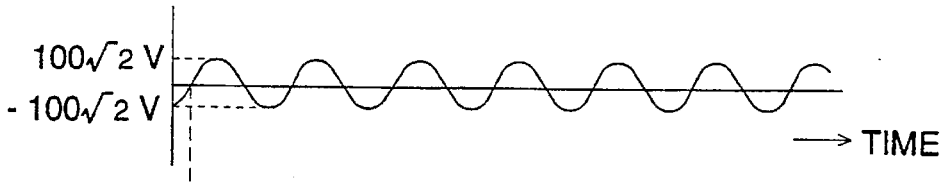
PRIOR ART FIG. 18 (a)
FIGS. 18(*a*)–18(*e*) represent a time chart showing behavior of a rush current in operations of a conventional fixing apparatus.
Figure 18:
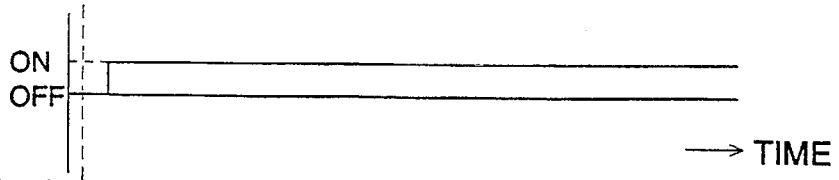
Figure 18:
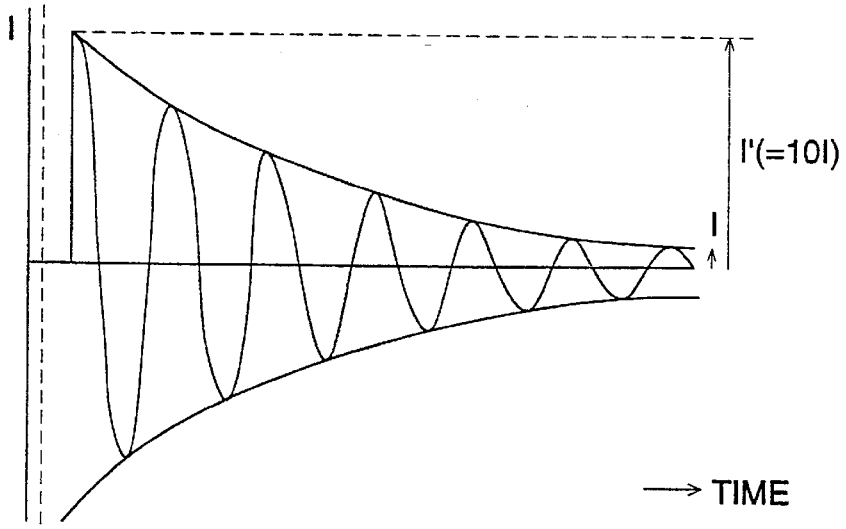
Figure 18:
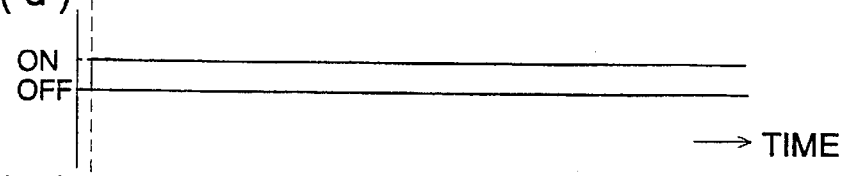
Figure 18:
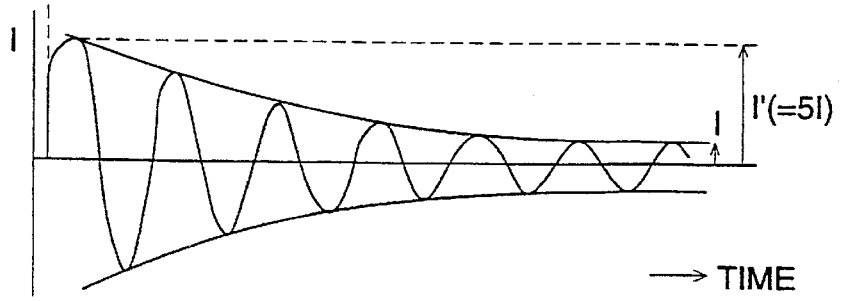
Figure 19:
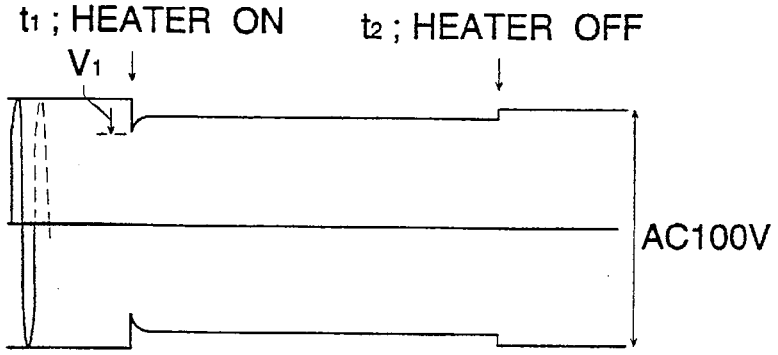
FIG. 19 PRIOR ART
FIG. 19 represents a time chart showing how power supply voltage is lowered in operations of a conventional fixing apparatus.
Figure 20:
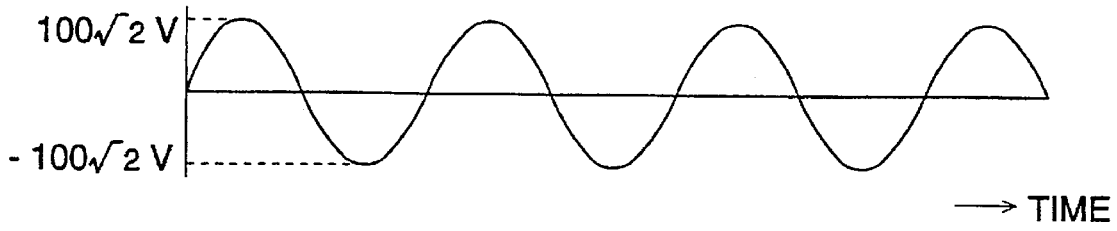
FIG. 20 (a) PRIOR ART
FIGS. 20(*a*) and 20(*b*) represent time charts; showing waveforms of voltage and current in a soft starter circuit in which continuity angle control is employed.
Figure 20:
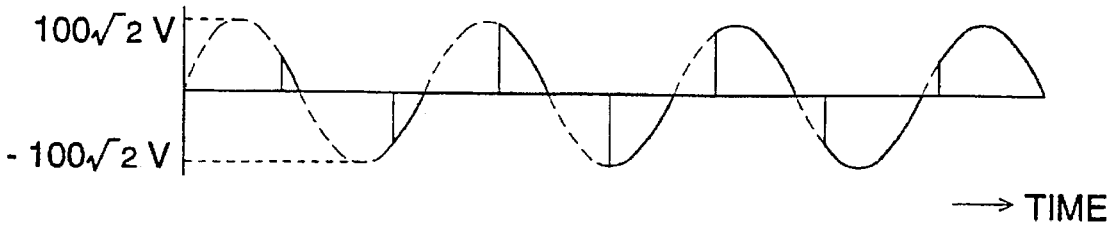
FIG. 20 (b) PRIOR ART
Figure 21:
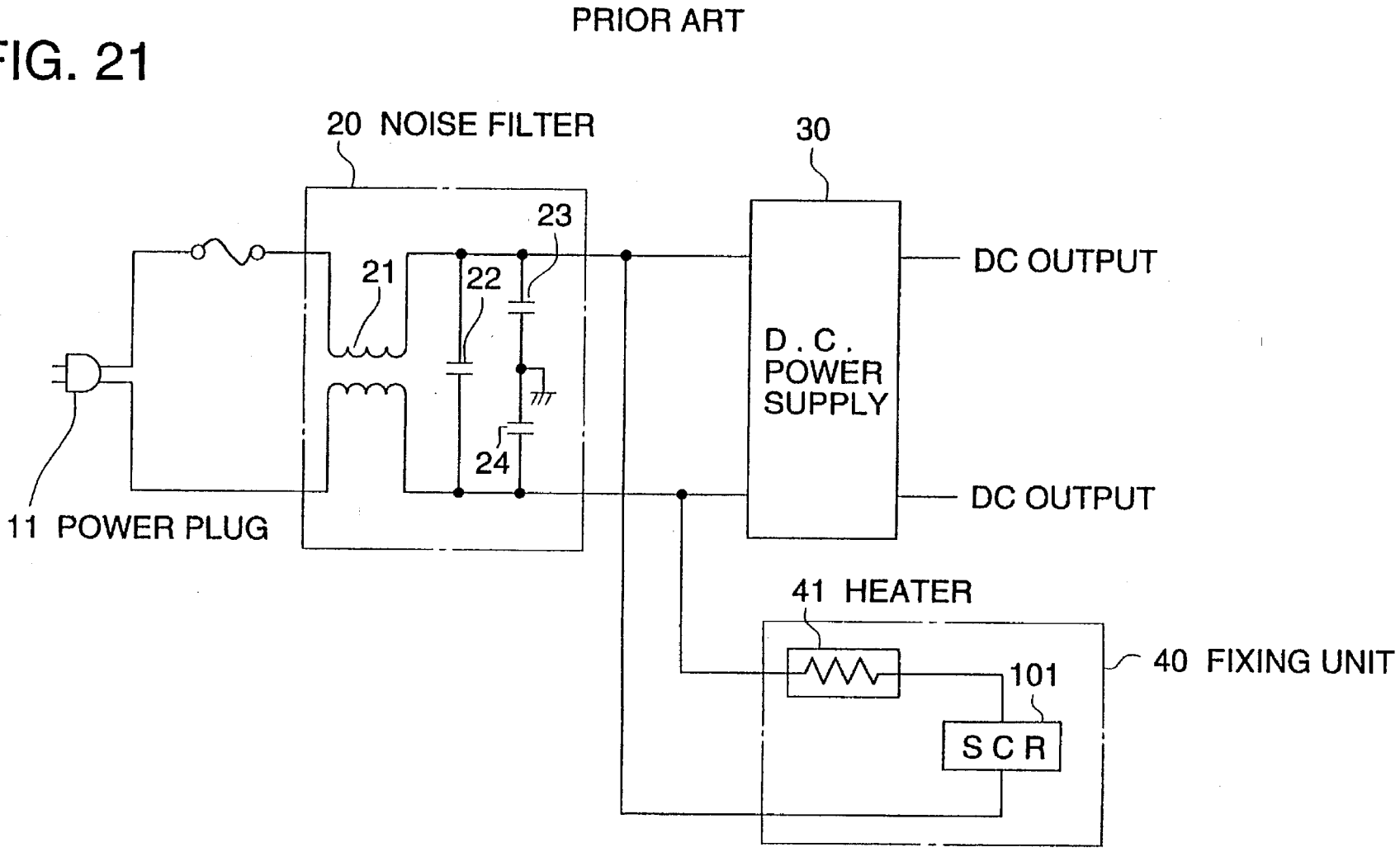
FIG. 21 is a structural diagram showing the total structure of a conventional fixing apparatus.
Figure 22:
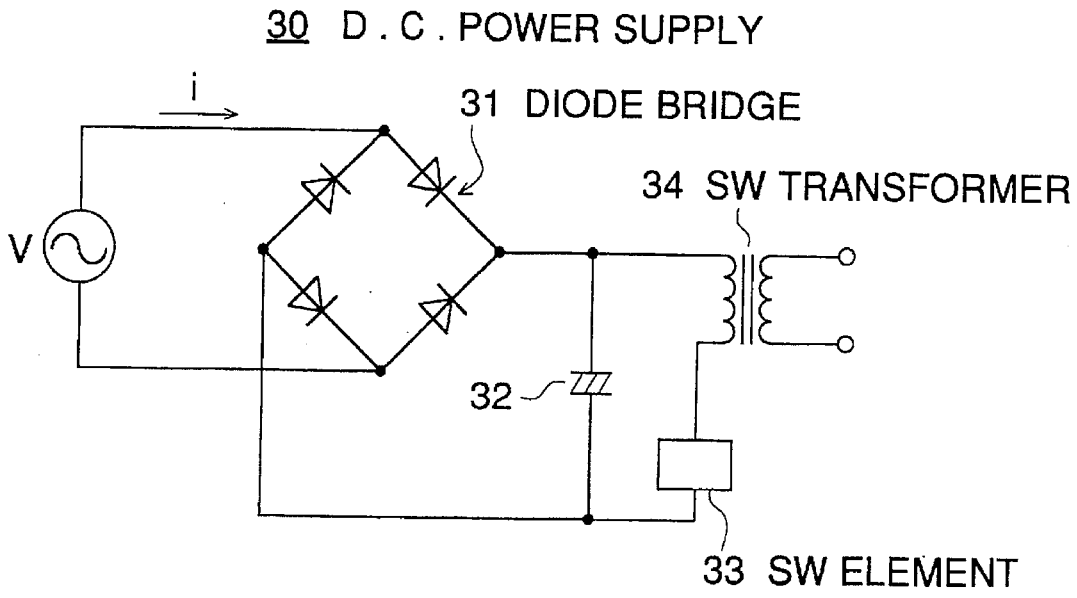
FIG. 22 PRIOR ART
FIG. 22 is a structural diagram showing the total structure of a conventional D.C. power supply.

Therefore, a waveform of an electric current flowing through the bi-directional and 3-terminal thyristor 3 in the state of half-wave rectification state is made to be one shown in (1) of FIG. 2(*d*) during a period of half-wave drive. Namely, since the resistance value of heater 4 in the state of OFF is low, a current value at the moment of start flowing is great, and it falls gradually. In this case, the peak value is the same as that in the conventional zero-cross control shown in FIG. 18(*e*).

FIG. 2(*e*) shows how voltage is lowered, and even in this case, variation is made with frequency of power supply, and the peak value is the same as that in the conventional zero-cross control.

However, it is generally known that human eyes have characteristics that they are sensitive to the fluctuation in the vicinity of 8.8 Hz, and the sensitivity is lowered for both cases that the frequency is higher than 8.8 Hz and it is lower than 8.8 Hz. Therefore, the portion of variation of power supply frequency shown in FIG. 2(*e*) is not sensed, and dotted lines are actually sensed.

Namely, at the moment when heater ON signals are changed to ON, the use of the heater controlling apparatus of the present example makes the flicker that corresponded to V1 in the past to be felt only as V2 (=½×V1).

A period of time required for a current value after half-wave rectification to reach the value almost twice that of the constant current value is measured in advance, and this timing is taken into consideration to cause full-wave drive signals to be ON. The selector 9 that has received full-wave drive signals supplies zero-cross pulses for full-waved drive to light-emitting section 10 as drive pulses. Accordingly, the photo-thyristor which has received light from the light-emitting section 10 is triggered for a period of full-wave to be on the state of continuity, and the bi-directional and 3-terminal thyristor 3 is also made to be on the state of continuity (full-wave rectification state) for a period of both A.C. directions (FIG. 2(*d*) (2)).

Immediately after the heater ON signals are changed to OFF, full-wave drive signals are caused to be OFF, and simultaneously with that, half-wave drive signals are changed to the state of ON (FIG. 2(*c*), (*b*)) which is maintained for a certain period.

The selector 9 received the half-wave drive signals again as stated above supplies zero-cross pulses for half-wave drive to light-emitting section 10 for a period of receiving the half-wave drive signals, as drive pulses. Accordingly, a photo-thyristor which has received light from the light-emitting section 10 is triggered only for a period of the half-wave to be on the state of continuity, and bi-directional and 3-terminal thyristor 3 is also caused to be on the state of continuity (half-wave rectification state) only for a period of half-wave.

Therefore, a waveform of an electric current flowing through the hi-directional and 3-terminal thyristor 3 in the state of half-wave rectification state is made to be one shown in (3) of FIG. 2(*d*) during a period of half-wave drive. Accordingly, variation portion V3 of power supply frequency in (3) of FIG. 2(*e*) is not felt, but it is actually felt as if it is a half variation to be ½×V3 like a dotted line.

Namely, at the moment when heater ON signals are changed to OFF, the use of the heater controlling apparatus of the present example makes the flicker that corresponded to V3 in the past to be felt as a half flicker of about ½×V3 at two times including when half-wave drive signals are changed to ON and when they are changed to OFF.

Incidentally, in the above examples, half-wave drive is performed at both timing of when the heater is turned ON and it is turned OFF. However, a great effect can be obtained by performing half-wave drive at least when the heater is turned ON.

Further, when the half-wave drive is performed at both timing of when the heater is turned ON and turned OFF, the direction of a current of each half-wave drive may either be the same or be opposite.

Further, in the above examples, a bi-directional and 3-terminal thyristor and a photo-thyristor are used so that full-wave/half-wave switching can be done. However, it is possible to change the circuit by using various switching elements which can switch between full-wave and half-wave at zero-cross timing in accordance with heater ON signals.

In the present example, half-wave drive pulses and full-wave drive pulses are generated in accordance with heater ON signals coming from the outside, and the switching means supplies power supply to the heater by switching between A.C. half-wave drive and A.C. full-wave drive at zero-cross timing by means of the pulses mentioned above. In this case, the A.C. half-wave drive is performed immediately after the heater ON, and the A.C. full-wave drive is performed after a certain period from the heater ON. By performing the drive of switching full-wave and half-wave, half-wave drive was performed with commercial power supply frequency which is hard to be sensed by human eyes, though a peak value of rush current and a peak value of voltage fall thereby remained unchanged from those in a conventional zero-cross method. Therefore, voltage fall was felt as if it was halved, and flicker can be reduced accordingly.

In the present example, half-wave drive pulses and full-wave drive pulses are generated in accordance with heater ON signals coming from the outside, and the switching means supplies power supply to the heater by switching between A.C. half-wave drive and A.C. full-wave drive at zero-cross timing by means of the pulses mentioned above. In this case, the A.C. half-wave drive is performed immediately after the heater ON, the A.C. full-wave drive is performed after a certain period from the heater ON and A.C. half-wave drive is performed at the moment of heater OFF. By performing the drive of switching full-wave and half-wave, half-wave drive was performed with commercial power supply frequency which is hard to be sensed by human eyes, though a peak value of rush current at the moment of heater ON and peak values of voltage fall thereby and voltage rise at the moment of heater OFF remained unchanged from those in a conventional zero-cross method. Therefore, voltage fall was felt as if it was halved, and flicker can be reduced accordingly.

The examples (3)–(12) mentioned above will be explained in detail as follows, referring to the drawings.

Constitution of a fixing apparatus

Figure 3:
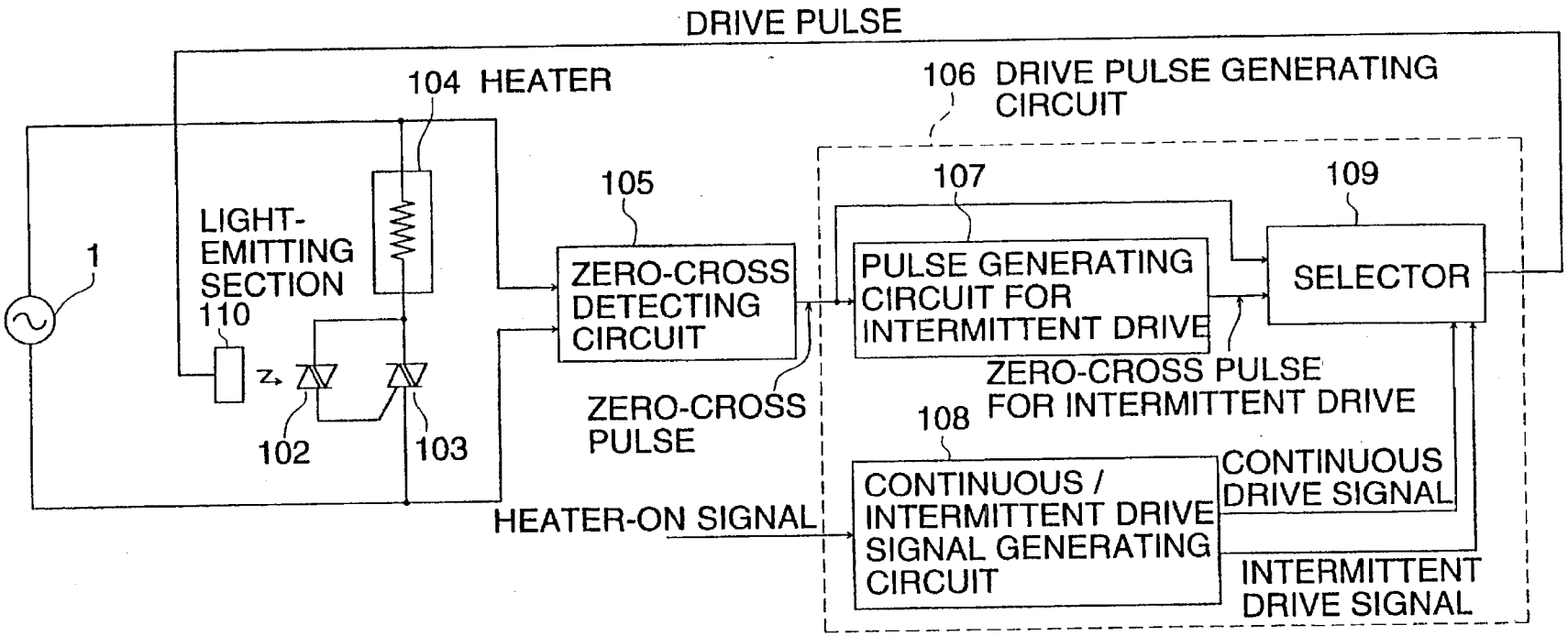
FIG. 3 is a structural diagram showing the constitution of a fixing apparatus that is an example of the invention.
Figure 4:
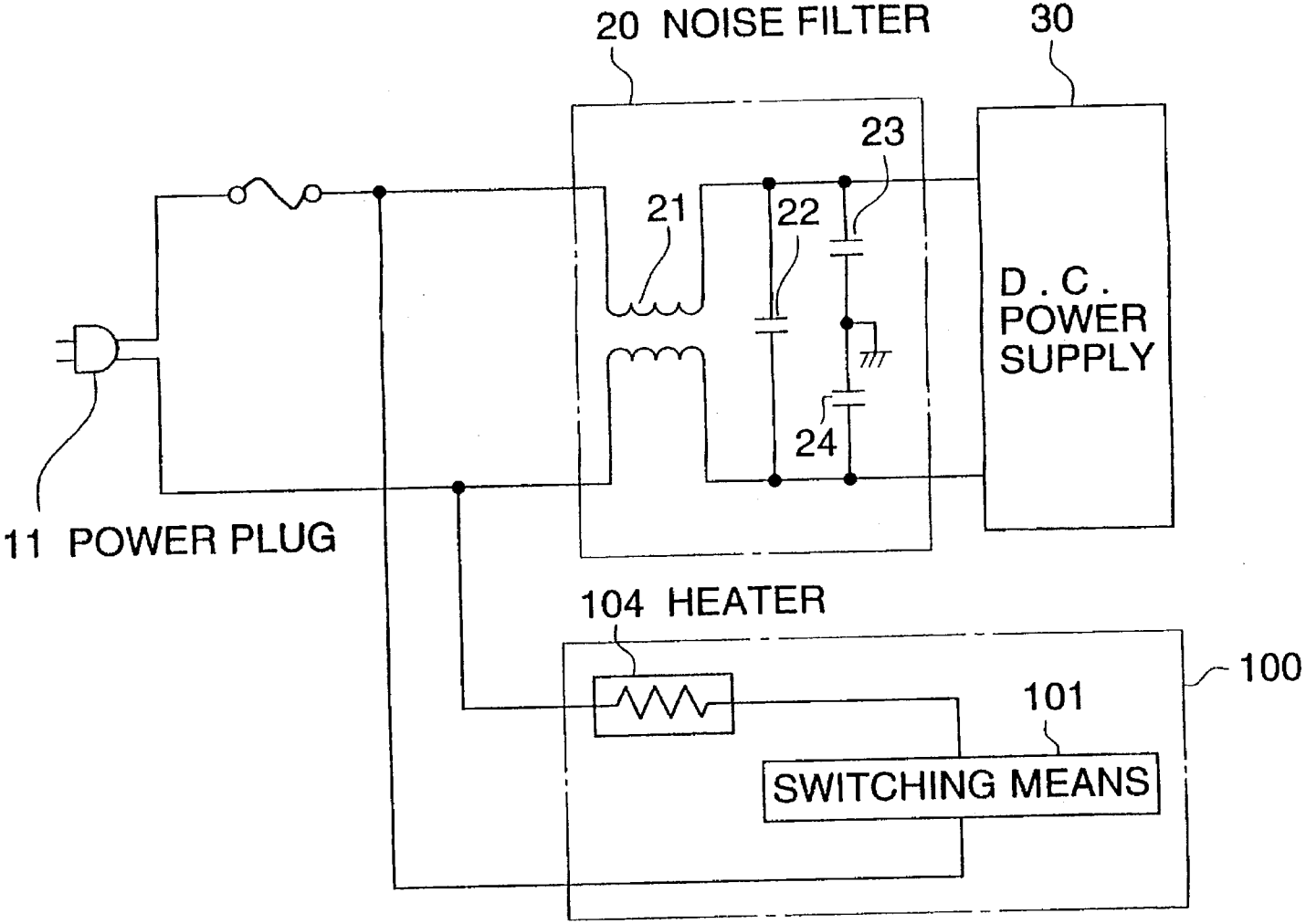
FIG. 4 is a structural diagram showing the total constitution of a fixing apparatus that is an example of the invention.

FIG. 3 shows schematic constitution of fixing apparatus 100 in an example of the invention. FIG. 4 shows how the fixing apparatus 100 is connected to the surrounding thereof.

In FIGS. 3 and 4, power supply 1 represents the power supply that is a base for supplying power to a fixing apparatus, and FIG. 1 shows an occasion wherein A.C. (50 Hz or 60 Hz) commercial power supply is used as it is. Incidentally, without being limited to commercial power supply, the power supply such as an independent power plant having the similar frequency can also be employed.

Photo-thyristor 102 is a thyristor that is turned on by light projected thereon and triggers bi-directional and 3-terminal thyristor 103 which will be stated later.

The bi-directional and 3-terminal thyristor 103 is a switching element that is triggered by the photo-thyristor 102 to be used through switching between intermittent drive and continuous drive.

Heater 104 is a halogen heater of a fixing apparatus and it is controlled in terms of current by bi-directional and 3-terminal thyristor 103.

Zero-cross detecting circuit 105 is a circuit that detects zero-cross timing of voltage of power supply 1, and it outputs pulses (zero-cross pulses) on zero-cross timing.

Pulse generating circuit for intermittent drive 107 receives zero-cross pulses from zero-cross detecting circuit 105, and outputs only pulses (zero-cross pulses for intermittent drive) on zero-cross timing of a prescribed pattern for intermittent drive. Continuous/intermittent drive signal generating circuit 108 is a circuit that receives heater ON signals and generates drive signals (continuous drive signals and intermittent drive signals: or, continuous/intermittent drive signals) used for switching continuous/intermittent drive on a prescribed timing, and its output is supplied to selector 109. The selector 109 receives zero-cross pulses, zero-cross pulses for intermittent drive, or continuous/intermittent drive signals, and generates pulses (drive pulses) for driving photo-thyristor 102.

Incidentally, it is assumed that the pulse generating circuit for intermittent drive 107 signal generating circuit for continuous/intermittent drive 108 and selector 109 are collectively called drive pulse generating circuit 106.

Light-emitting section 110 is one that receives drive pulses and emits light for driving a photo-thyristor, and it is provided in the vicinity of a light-receiving section inside the photo-thyristor 102.

Further, switching means 101 is composed of drive pulse generating circuit 106, light-emitting section 110, a photo-thyristor and bi-directional and 3-terminal thyristor 103.

Concrete example of intermittent drive

For reducing flicker, the invention is characterized in that zero-cross lighting of an intermittent drive pattern is carried out for a prescribed period of time from at least ON timing. Now, concrete examples of this intermittent drive pattern will be explained as follows, referring to the drawings.

Figure 8:
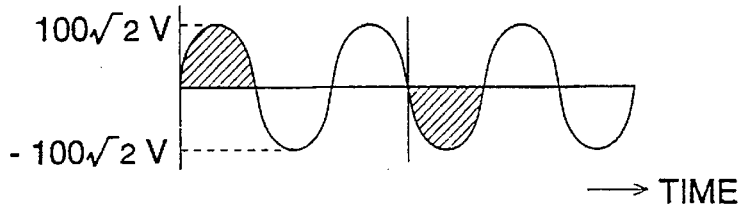
FIGS. 8(*a*) and 8(*b*) represent an illustration showing a lighting pattern that is an example of the invention.
Figure 8:
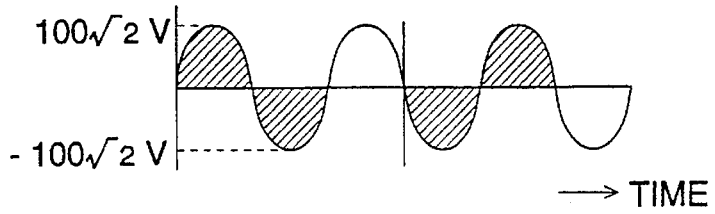

FIG. 8 shows a drive pattern wherein ON/OFF is repeated in 1.5 cycles, and ON for 0.5 cycles and OFF for 1 cycle are repeated in FIG. 8(*a*), while, ON for 1 cycle and OFF for 0.5 cycles are repeated in FIG. 8(*b*).

Figure 9:
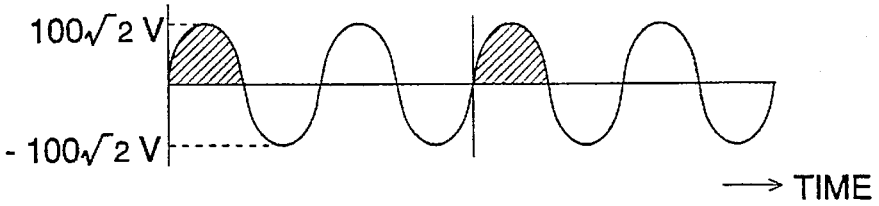
FIGS. 9(*a*)–9(*c*) represent an illustration showing a lighting pattern that is an example of the invention.
Figure 9:
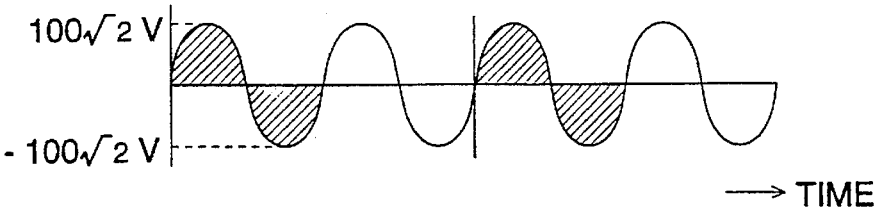
Figure 9:
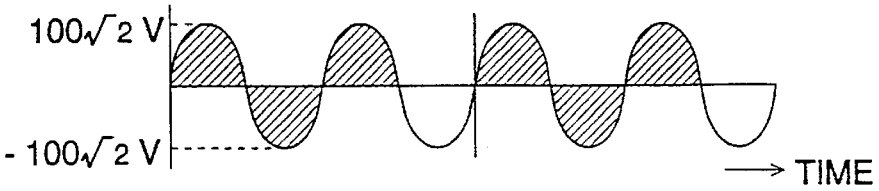

FIG. 9 shows a drive pattern wherein ON/OFF is repeated in 2 cycles, and ON for 0.5 cycles and OFF for 1.5 cycles are repeated in FIG. 9(*a*), while, ON for 1 cycle and OFF for 1 cycle are repeated in FIG. 9(*b*), and ON for 1.5 cycles and OFF for 0.5 cycles are repeated in FIG. 9(*c*).

Figure 10:
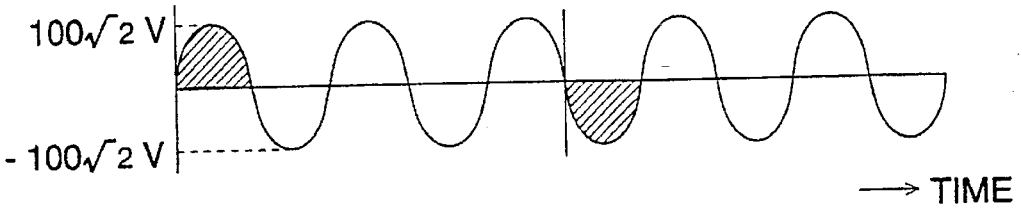
FIGS. 10(*a*)–10(*d*) represent an illustration showing a lighting pattern that is an example of the invention.
Figure 10:
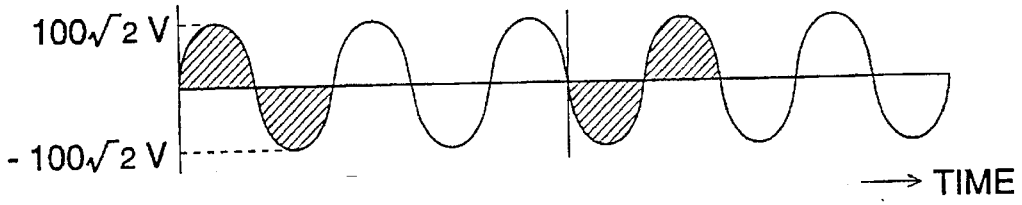
Figure 10:
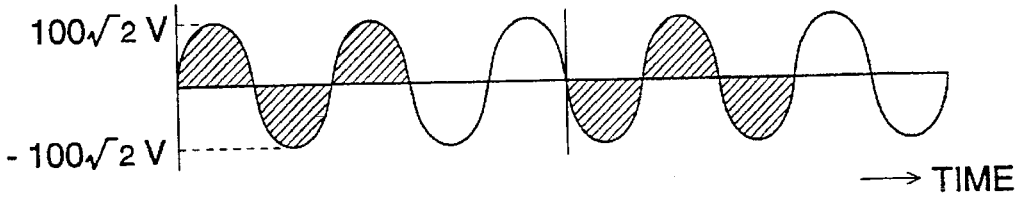
Figure 10:
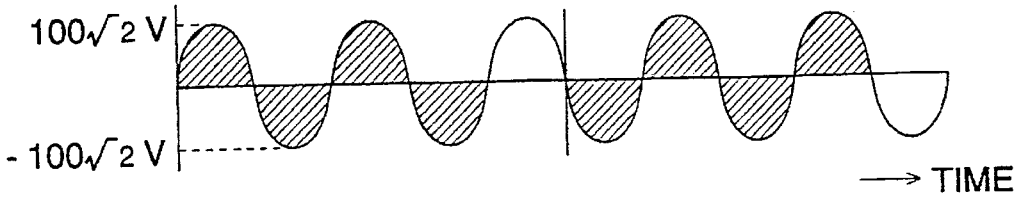

FIG. 10 shows a drive pattern wherein ON/OFF is repeated in 2.5 cycles, and ON for 0.5 cycles and OFF for 2 cycles are reported in FIG. 10(*a*), while, ON for 1 cycle and OFF for 1.5 cycles are repeated in FIG. 10(*b*), ON for 1.5 cycles and OFF for 1 cycle are repeated in FIG. 10(*c*), and ON for 2 cycles and OFF for 0.5 cycles are repeated in FIG. 10(*d*).

Figure 11:
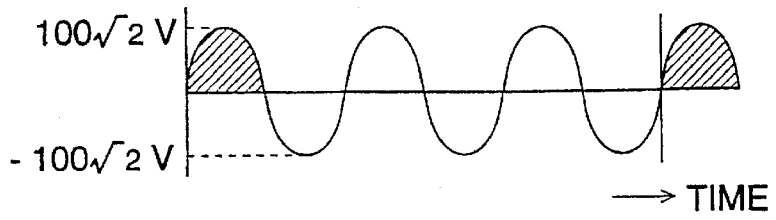
FIGS. 11(*a*)–11(*e*) represent an illustration showing a lighting pattern that is an example of the invention.
Figure 11:
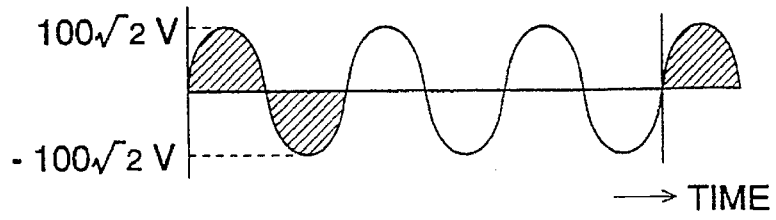
Figure 11:
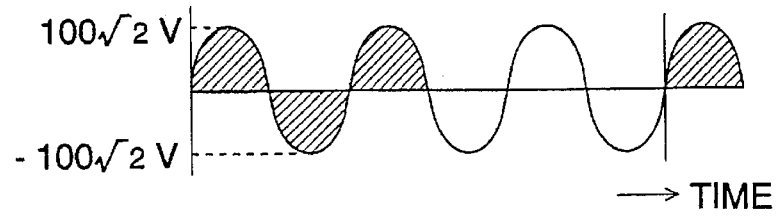
Figure 11:
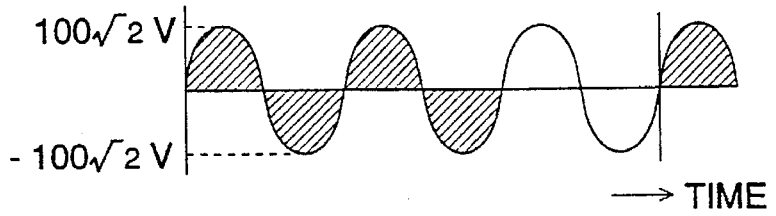
Figure 11:
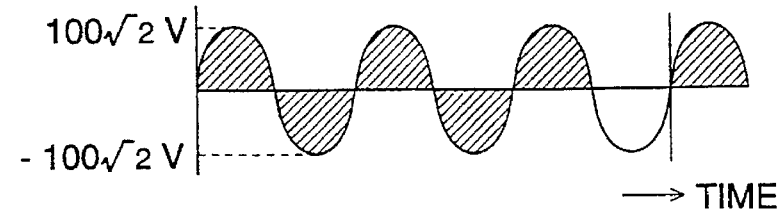

FIG. 11 shows a drive pattern wherein ON/OFF is repeated in 3 cycles, and ON for 0.5 cycles and OFF for 2.5 cycles are repeated in FIG. 11(*a*) , while, ON for 1 cycle and OFF for 2 cycles are repeated in FIG. 11(*b*), ON for 1.5 cycles and OFF for 1.5 cycles are repeated in FIG. 11(*c*), ON for 2 cycles are OFF for 1 cycle are repeated in FIG. 11(*d*), and ON for 2.5 cycles and OFF for 0.5 cycles are repeated in FIG. 11(*e*).

Figure 12:
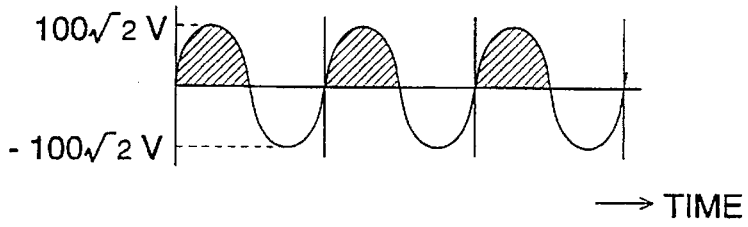
FIGS. 12(*a*)–12(*d*) represent an illustration showing a lighting pattern that is an example of the invention.
Figure 12:
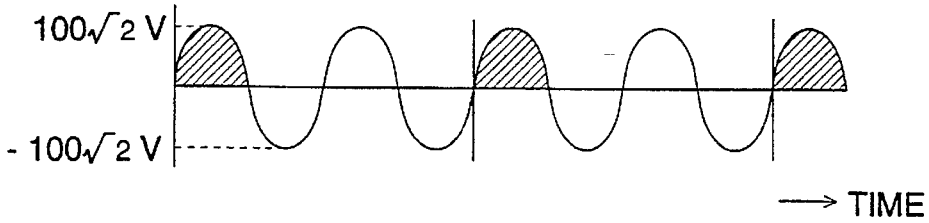
Figure 12:
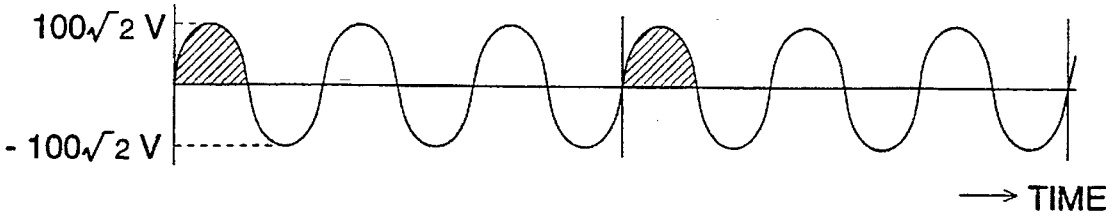
Figure 12:
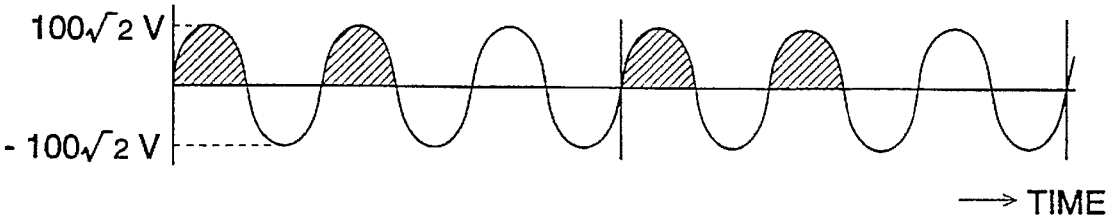

FIG. 12 shows intermittent drive represented by examples of half-wave drive, and ON for 0.5 cycles and OFF for 0.5 cycles are repeated in FIG. 12(*a*), ON for 0.5 cycles and OFF for 1.5 cycles are repeated in FIG. 12(*b*), ON for 0.5 cycles and OFF for 2.5 cycles are repeated in FIG. 12(*c*), and ON for 2 half waves only among 3 cycles is repeated in FIG. 12(*d*).

Measurement of flicker

Figure 13:
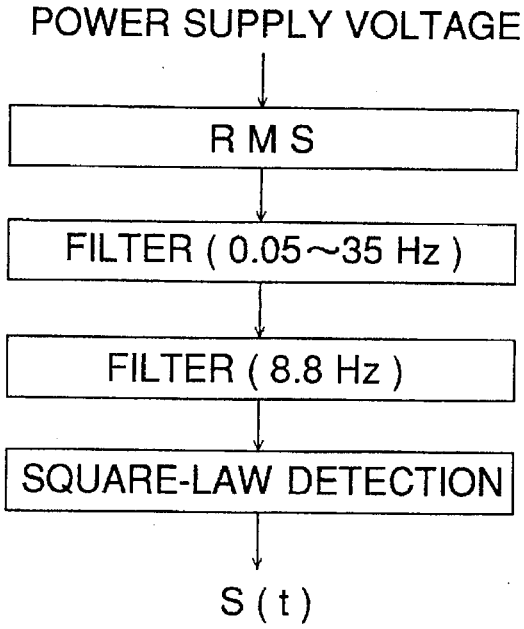
FIG. 13 is an illustration showing how flicker is measured.

FIG. 13 shows how the flicker is measured. With regard to the measurement of flicker, there are stipulated as follows in IEC 868.

(1) To obtain an RMS value of power supply voltage at intervals of a half cycle.

(2) To pass through a 0.05 Hz–35 Hz band pass filter.

(3) To pass through a band pass filter for the center frequency of 8.8 Hz.

(4) To conduct square-law detection, and to obtain instantaneous flicker S (t) after normalizing with initial power supply voltage.

Figure 14:
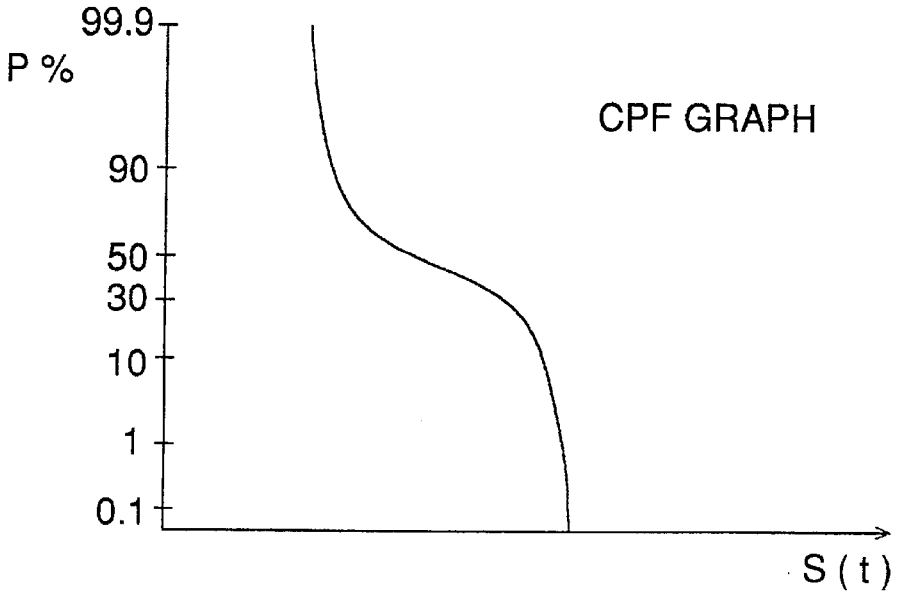
FIG. 14 is a graph of a cumulative probability function showing how flicker is measured.

Through the procedures mentioned above, it is possible to obtain flicker of voltage fluctuation component in which the frequency of 8.8 Hz contained in power supply voltage is a center of sensitivity. Incidentally, this 8.8 Hz is stipulated as a frequency to which a human being is most sensitive, From the data of measurement of S(t) for a prescribed period of time, a cumulative probability function is obtained. FIG. 14 is a graph of the cumulative probability function wherein the horizontal axis represents S(t) and the vertical axis represents cumulative appearance frequency of S(t) in %.

From this function, instantaneous flicker Pst can be obtained through the following expressions.

$$P(50S)=\{P(30)+P(50)+P(80)\}/3$$

$$P(10S)=\{P(6)+P(8)+P(10)+P(13)+P(17)\}/5$$

$$P(3S)=\{P(2.2)+P(3)+P(4)\}/3$$

$$P(1S)=\{P(0.7)+P(1)+P(1.5)\}/3$$

$$Pst=(0.0314P(0.1)+0.525P(1S)+0.0657P(3S)+0.28P(10S)+0.08P(50P))^{1/2}$$

wherein P(n) represents a value of S(t) under the probability of n%.

A limit value of the instantaneous flicker value Pst obtained through the foregoing is stipulated in IEC 1000-3-3 as follows.

$$Pst \leqq 1.0$$

Operations of a fixing apparatus

Operations of the fixing apparatus constituted as described above will be explained as follows, referring to the time chart in FIG. 15.

When heater ON signals are turned ON as a result of detection of an unillustrated temperature detecting circuit, continuous/intermittent drive signal generating circuit 108 generates intermittent drive signals immediately after heater ON, continuous drive signals after A.C. intermittent drive for a certain period, and intermittent drive signals at the moment of OFF. Incidentally, it is satisfactory that intermittent drive signals are generated at least immediately after heater ON. Therefore, intermittent drive signals may either be generated or not be generated at the moment of OFF.

Figure 15:
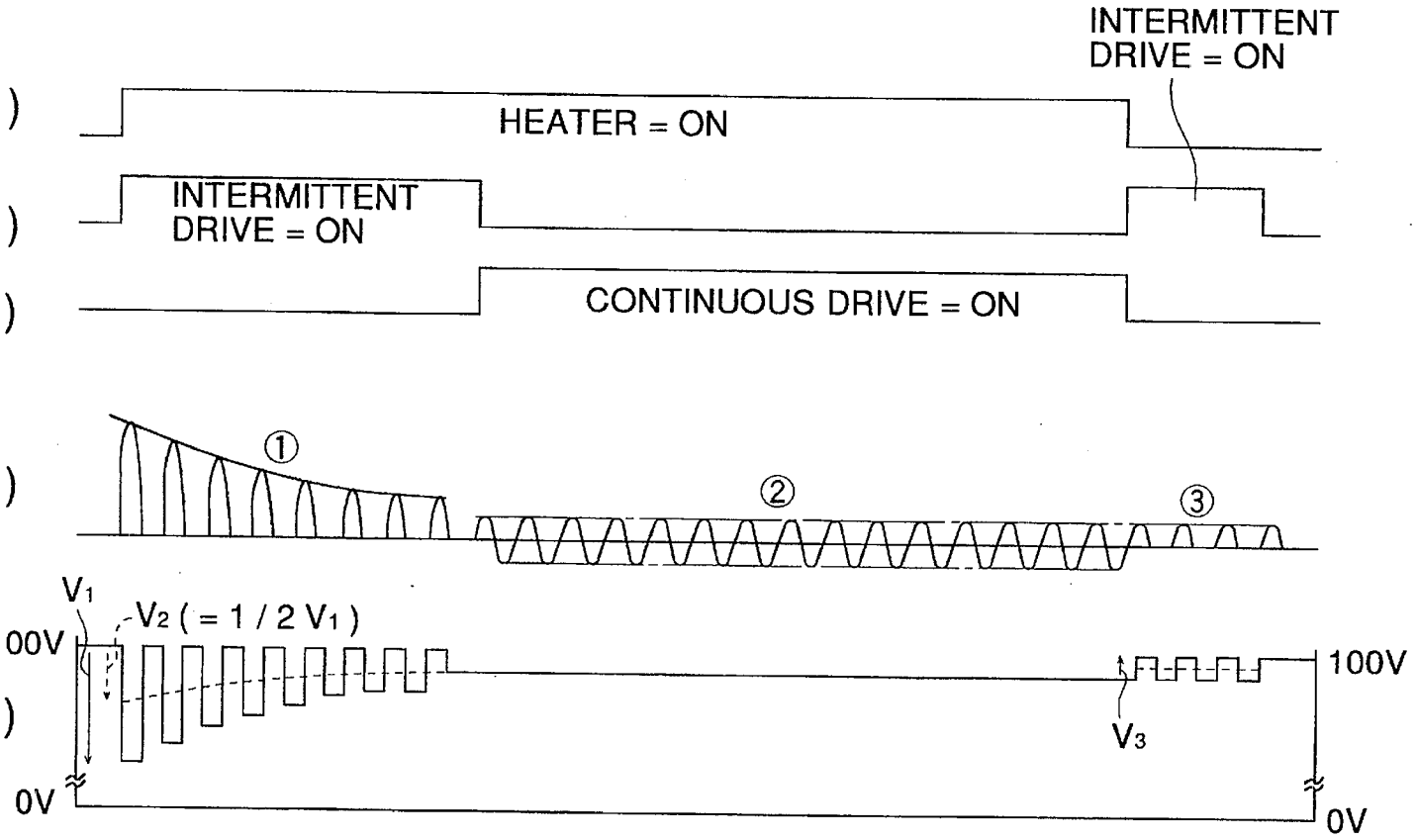
FIGS. 15(*a*)–15(*e*) represent a time chart showing operations of a fixing apparatus that is an example of the invention.

FIG. 15(*a*) shows heater ON signals, wherein intermittent drive signals are turned ON immediately after ON of the heater ON signals (FIG. 15(*b*)), and continuous drive signals are turned ON after a certain period of time from ON of the heater ON signals (FIG. 15(*c*)). Then, the intermittent drive signals are turned ON again for a certain period immediately after OFF of the heater ON signals (FIG. 15(*b*)).

The following discussion considers a certain period immediately after ON of heater ON signals.

Selector 109 which has received the intermittent drive signals mentioned above supplies zero-cross pulses for intermittent drive to light-emitting section 110 as drive pulses during a period of receiving the intermittent drive signals. Therefore, a photo-thyristor which has received light from the light-emitting section 110 is triggered to be in the state of continuity only for an intermittent certain period, and bi-directional and 3-terminal thyristor 103 is also made to be in the state of continuity (intermittent rectification state) only for an intermittent certain period.

Incidentally, it is satisfactory that either an intermittent drive signal in this case or a zero-cross pulse for intermittent drive is a signal or a pulse that realizes any drive pattern in FIGS. 8–12.

Here, an example of half-wave drive shown in FIG. 12(*a*) will be explained.

Therefore, a waveform of an electric current flowing through the bi-directional and 3-terminal thyristor 103 that is in the state of intermittent rectification takes the form shown in (1) of FIG. 15(*d*) for an intermittent drive period. Namely, since the resistance value under the OFF state of heater 104 is low, a value of an electric current at the moment when the electric current starts flowing is large, and it is lowered gradually. In this case, a peak value is the same as that in the case of the conventional zero-cross control shown in FIG. 18(*e*).

Further, FIG. 15(*e*) shows how voltage is lowered, and in this case again, fluctuation is made with a frequency of power supply and a peak value is the same as that in the case of a conventional zero-cross control.

However, it is generally known that human eyes have characteristics that they are highly sensitive to the fluctuation in the vicinity of 8.8 Hz, and there sensitivity is lower for frequencies lower and higher than 8.8 Hz. Therefore, fluctuation portions of power supply frequency in FIG. 15(*e*) are not sensed, and they are actually sensed as if they are represented by dotted lines.

Namely, at the moment when heater ON signals are turned ON, the flicker which used to be sensed to correspond to V1 in the past is sensed to correspond to about V2 (=½×V1), when a fixing apparatus in the present example is used.

Then, a period of time necessary for the value of a current rectified intermittently to reach the value that is about two times that of a constant current is measured in advance, and continuous drive signals are turned ON at the timing of the measured time mentioned above. Selector 109 which has received the continuous drive signals mentioned above supplies zero-cross pulses for continuous drive to light-emitting section 110 as drive pulses. Therefore, a photo-thyristor which has received light from light-emitting section 110 is triggered to be in the state of continuity for a full-wave period, and bi-directional and 3-terminal thyristor 103 is also made to be in the state of continuity (full-wave rectification state) for a period of A.C. both directions (FIG. 15(*d*)(2)).

Then, immediately after heater ON signals are tuned OFF, continuous drive signals are turned OFF and simultaneously with that, intermittent drive signals are tuned ON (FIGS. 15(*c*) and 15(*b*)) to continue their state of ON for a certain period.

The selector 109 which has received intermittent drive signals again supplies zero-cross pulses to the light-emitting section 110 as drive pulses in a period of receiving the intermittent drive signals. Accordingly, the photo-thyristor which has received light from the light-emitting section 110 is triggered to be in the state of continuity only for a intermittent prescribed period, and bi-directional and 3-terminal thyristor 103 is also made to be in the state of continuity (intermittent rectification state) only for a prescribed intermittent certain period.

Therefore, a wave form of an electric current flowing through the bi-directional and 3-terminal thyristor 103 that is in the state of intermittent rectification takes the form shown in (3) of FIG. 15(*d*) for an intermittent drive period. Therefore, fluctuation portions V3 of power supply frequency in FIG. 15(*e*) (3) are not sensed, but they are actually sensed as a half fluctuation of ½ V3 shown by dotted lines.

Namely, at the moment when heater ON signals are turned ON, the flicker which used to be sensed to correspond to V3 in the past in sensed as a half flicker of about ½×V3 for two different occasions of the moment of ON and the moment of OFF of intermittent drive signals.

Incidentally, in the examples mentioned above, intermittent drive is performed at both timing of the moment to turn the heater ON and the moment to turn the heater OFF. However, a great effect can be obtained by performing the intermittent drive at least at the moment to turn the heater ON.

When performing the intermittent drive both at the moment of turning the heater ON and at the moment of turning the heater OFF, a pattern of each intermittent drive may be either the same as each other or different from each other.

Further, in the examples mentioned above, a bi-directional and 3-terminal thyristor and a photo-thyristor are used for the full-wave/half-wave switching. However, it is possible to modify a circuit by using various switching elements capable of performing full-wave/half-wave switching at zero-cross timing in accordance with heater ON signals.

When zero-cross lighting of an A.C. intermittent pattern is conducted during a prescribed period at least from ON timing as stated above, it is possible to lower the flicker component of a prescribed frequency to which a person is sensitive. Further, switching noise is hardly produced because continuity angle control is not conducted but zero-cross control is conducted.

As shown in FIG. 4, therefore, it is sufficient that common choke 21 for noise reduction is provided only on the side of D.C. power supply section 30. Therefore, an amount of current flowing through the common choke 21 is small, resulting in a small-sized choke having a fine diameter of wiring. Thereby, it is possible to realize a small-sized apparatus.

Incidentally, in the aforesaid (3)–(12) examples, a continuous pattern and an intermittent pattern are generated independently and are switched by a selector. However, it is also possible to generate continuous/intermittent patterns for a prescribed period with a pulse generating circuit itself, synchronizing with heater ON/OFF signals.

Figure 5:
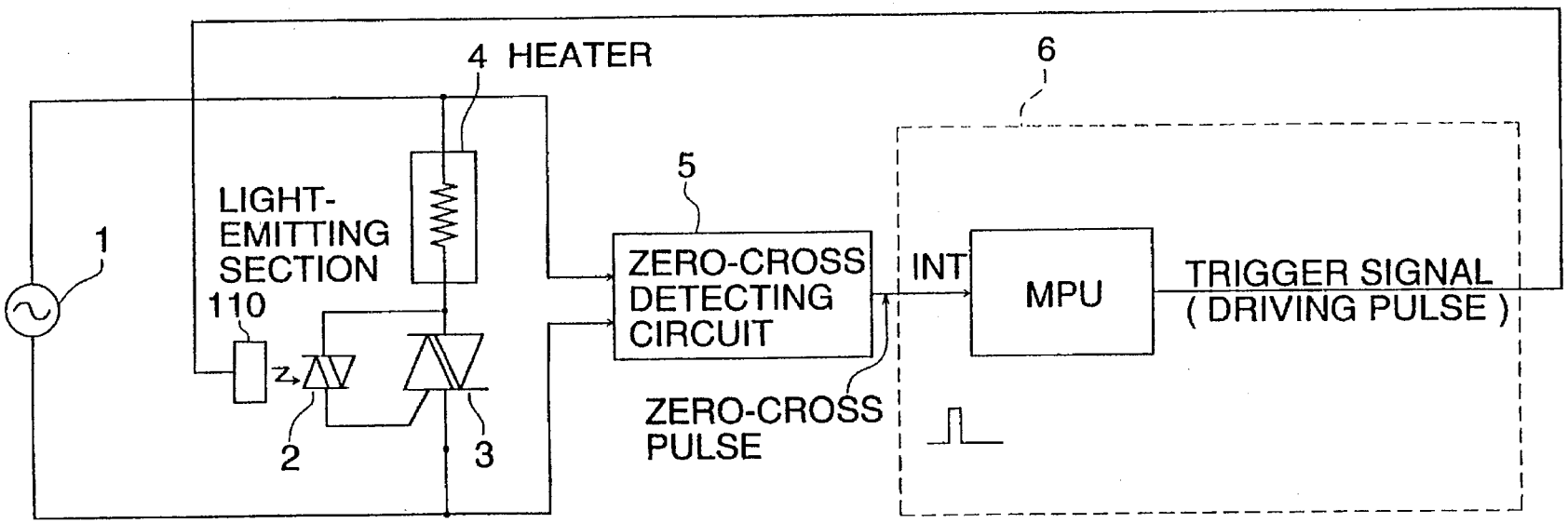
FIG. 5 is a structural diagram showing the constitution of a fixing apparatus that is an example of the invention.

In the examples described above, intermittent drive pulses and full-wave drive pulses are generated by the hardware circuit of drive pulse generating circuit 106 based on both zero-cross pulses and heater lighting signals. However, they may further be generated by a software in MPU in accordance with a flow based on both zero-cross pulses and ON/OFF timing of the heater as shown in FIGS. 5–7.

Figure 6:
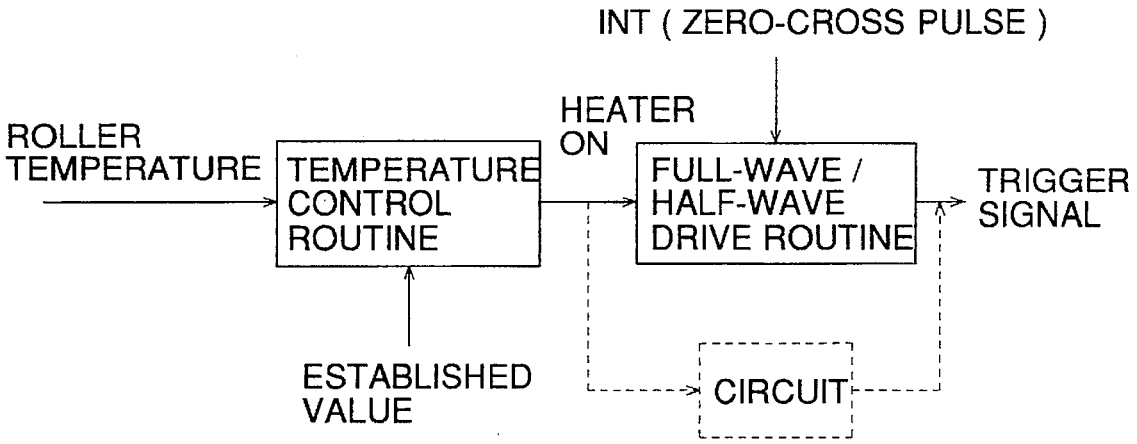
FIG. 6 is a conceptual diagram showing control of heater temperature in a fixing apparatus that is an example of the invention.

FIG. 6 shows a total flow of temperature control for the heater, which indicates an example that half-wave drive is conducted for a certain period of time only when the heater is ON. In addition, it is further possible, by changing the software partially, to make three half-waves to be lit once.

In the case of FIG. 6, a roller temperature and a temperature established value are used for judging whether the heater should be turned ON or not, and when ON is selected, heater ON is instructed to a full-wave/half-wave drive routine. In this case, the counter is made to be "20" to set the time for half-wave drive (FIG. 7(*a*)).

Figure 7:
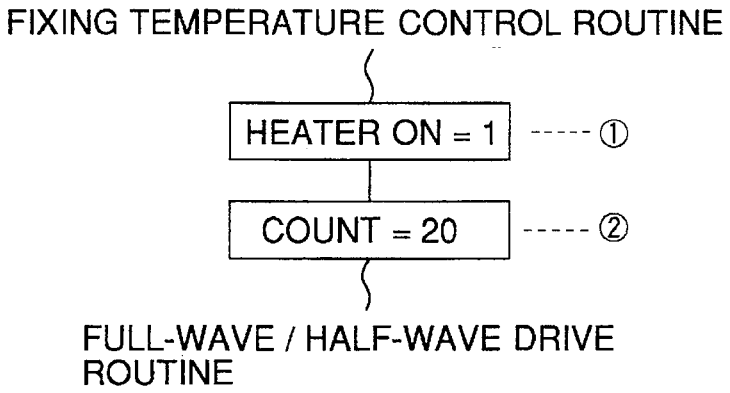
FIGS. 7(*a*) and 7(*b*) are flow control diagrams showing operations of a fixing apparatus that is an example of the invention.
Figure 7:
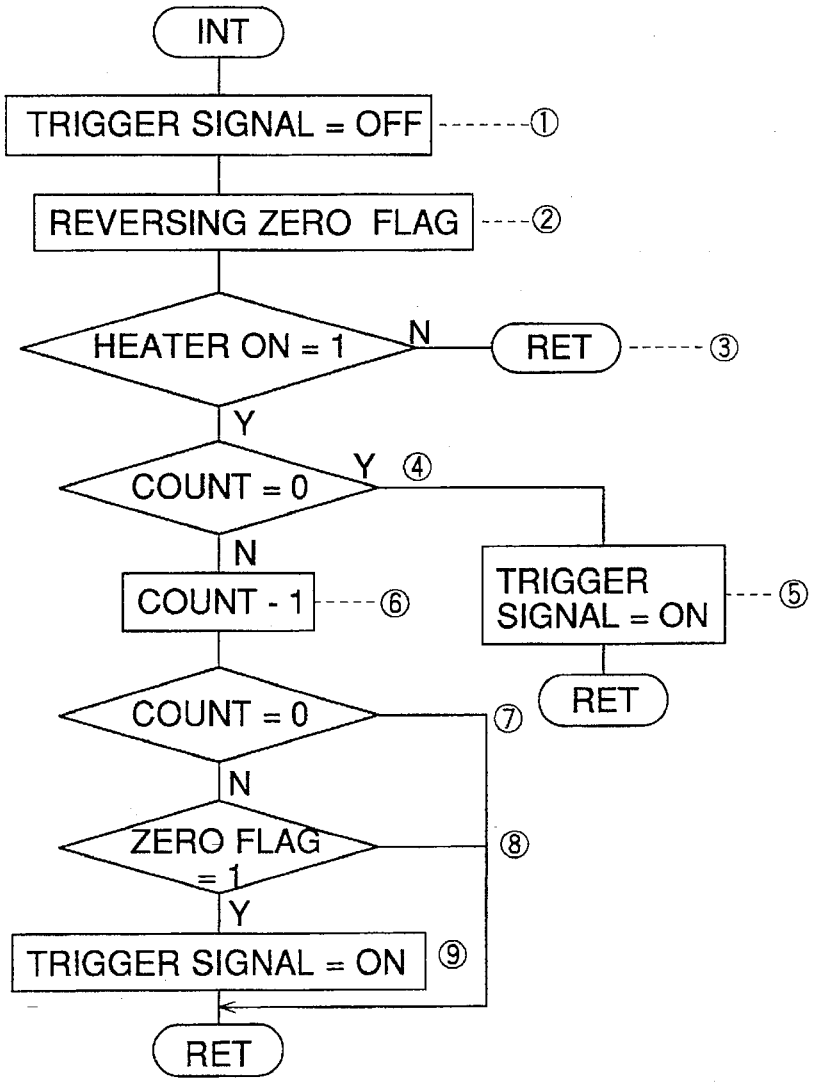

On the full-wave/half-wave drive routine, synchronization with zero-cross pulse is made, and based upon this, interruption processing is conducted (FIG. 7(*b*)).

Namely, zero-cross pulses are used to turn the trigger signal OFF temporarily (1) and to reverse a zero-flag (2). The zero-flag indicates whether the timing for A.C. waveform is for changing from '+' to '–' or for changing from '–' to '+'. In other words, each time this routine is passed through, it indicates the timing for the zero-cross pulse.

Next, when heater ON is instructed, the established value of the aforementioned counter is confirmed not to be zero (3), (4), (6) and (7), and trigger signals are turned ON only when the above-mentioned zero-flag is '1'. Namely, when this routine cycles repeatedly, the zero-flag and trigger signals are reversed in the following routine, as long as the count is not zero. Therefore, ON and OFF of the trigger signals are repeated alternately, and intermittent A.C. waveform in FIG. 12(*a*) is generated.

Incidentally, when the count is zero, trigger signal is ON for each zero-cross pulse (5), and thereby full-wave drive is continued.

In accordance with the constitution and drive patterns mentioned above, changes of flicker were measured, and results of the measurement are shown below.

Example 1: Drive pattern and flicker

Here, results of lighting cycle, lighting timing, repeating frequency and instantaneous flicker value Pst in Example 1 are shown in Table 1.

TABLE 1

-Experimental example 1: Drive pattern and flicker-

| Lighting cycle | Lighting (ON) timing | Repeating frequency | Pst |
|---|---|---|---|
| Continuous | Full-wave | 100 Hz | 0.934 |
| 1 cycle | Half-wave | 50 Hz | 0.558 |
| 1.5 cycles | 0.5, 1.0 | 33 Hz | 0.62–0.65 |
| 2.0 cycles | 0.5, 1.0, 1.5 | 25 Hz | 0.71–0.74 |
| 2.5 cycles | 0.5, 1.0, 1.5, 2.0 | 20 Hz | 0.77–0.82 |
| 3.0 cycles | 0.5, 1.0, 1.5, 2.0, 2.5 | 16.6 Hz | 0.84–0.87 |

Comparative example 1: Drive pattern and flicker

For the purpose of composition, results obtained as comparative examples concerning lightning cycles greater than 3 cycles are shown in table 2 below as Comparative example 1.

TABLE 2

-Comparative example 1: Drive pattern and flicker-

| Lighting cycle | Lighting (ON) timing | Repeating frequency | Pst |
|---|---|---|---|
| 3.5 cycle | 0.5, 1.0, 1.5, 2.0, 3.0 | 14.3 Hz | 0.95–1.02 |
| 4.0 cycle | 0.5, 1.0, 1.5, 2.0, 2.5, 3.0, 3.5 | 12.5 Hz | 1.01–1.25 |
| 4.5 cycles | 0.5, 1.0, 1.5, 2.0, 2.5, 3.0, 4.0 | 11.1 Hz | 1.35–1.45 |

Evaluation on Experimental example 1 and Comparative example 1

As a result of the foregoing, in the lighting cycle up to 3 cycles as shown in FIGS. 8–12 as a concrete example, excellent results that instantaneous flicker value P Pst is lower than 1 were obtained. Incidentally, in these drawings, a hatched portion represents lighting (ON).

Experimental example 2: Color temperature of heater and flicker

Figures 16, 17:
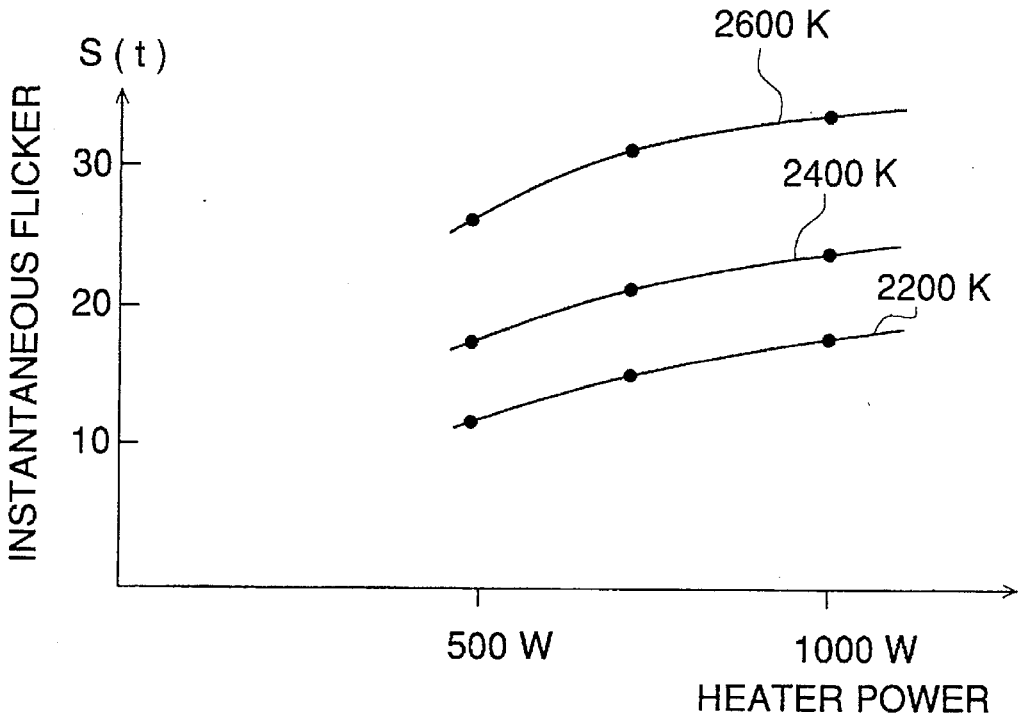
FIG. 16 is a characteristics diagram showing the results of experiments in an example of the invention.
FIG. 17 is a characteristics diagram showing the results of experiments in an example of the invention.

Inventors of the invention paid attention also to the relation between the color temperature of a halogen lamp serving as a heater and flicker, and found the condition with which the flicker can be inhibited. Results of the experiments are shown in FIGS. 16 and 17.

In this case, a 750-W lamp is used and lighting is on a repeating basis with 30-second ON and 30-second OFF. As is apparent from FIGS. 16 and 17, it is possible to comply with the flicker standards even in the case of using a common 500–1000 W lamp, by using a heater having the color temperature of 2200° k. Namely, when the heater having the color temperature of not more than 2200° k is used, a ratio of a resistance value in lights-out (low temperature) to that in lighting (high temperature) is smaller despite the same wattage, compared with an occasion where a heater having the color temperature higher than 2200° k is used. As a result, rust current is lowered which leads to the reeducation of flicker. In the case of the same color temperature, the smaller the W number is, the better the results obtained are.

Incidentally, it was confirmed through experiments that excellent results can be obtained with a lamp with a color temperature of 2200° k or less even under the condition other than that in Example 2, provided that the condition in within a range of the condition in the aforesaid Experimental example 1.

Experimental example 3: Drive pattern and noise

Figure 23:
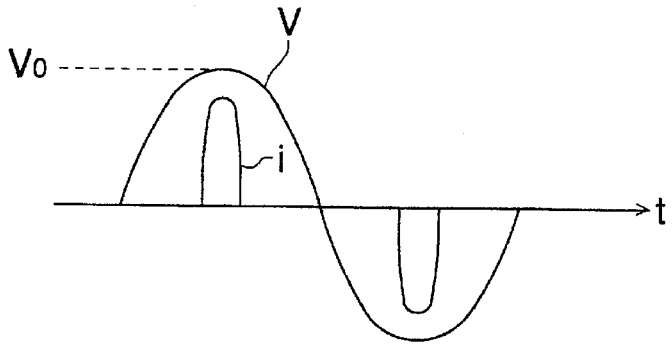
FIG. 23 PRIOR ART
FIG. 23 is a diagram of a waveform showing how an electric current of the D.C. power supply looks.

It is obtained through Fourier conversion that a harmonic contained in current that flows in the case of half-wave drive in FIG. 12 mentioned above is an even-number-order harmonic. It is therefore different in terms of order number from an add-number-order harmonic that is generated when D.C. power supply section 30 in FIG. 4 is of the constitution shown in FIG. 23. Therefore, it was confirmed that the harmonic mentioned above does not exceed the standard value and is allowed, even when each harmonic shows the maximum value of the noise standard.

As stated in detail above, a fixing apparatus or an electrophotographic apparatus of the invention wherein zero-cross lighting on an A.C. intermittent pattern is conducted during a prescribed period from at least ON timing makes it possible to reduce flicker component of a prescribed frequency to which a person is sensitive. Further, switching noise is hardly made because of the zero-cross control instead of continuity angle control.

Paying attention to the color temperature of a heat source for fixing also makes it possible to reduce flicker.

What is claimed is:

1. A fixing apparatus for an image forming apparatus, said fixing apparatus comprising:

a heater, adapted in said fixing apparatus, for heating a fixing member;

a zero-cross detector for detecting zero-cross timings of electric power when a voltage of said electric power is at zero volts;

a switching device for turning on and turning off supply of said electric power to said heater;

a controller for controlling said switching device so as to provide a first state in which said electric power is continuously supplied to said heater for a multiple of half-cycles from one of said zero-cross timings, and a second state in which said electric power is prevented to be supplied to said heater for a multiple of half-cycles from another of said zero-cross timings;

wherein said electric power is supplied to said heater with an intermittent pattern, including said second state, for a predetermined period after at least one of a turn-on operation of said heater and a turn-off operation of said heater.

2. The fixing apparatus of claim 1, wherein said controller generates intermittent pulses in said predetermined period and said switching means turns on and turns off supply of said electric power to said heater in response to said intermittent pulses.

3. The fixing apparatus of claim 1, wherein said controller generates continuous pulses in a period other than said predetermined period and said switching device allows continuous supply of said electric power to said heater in response to said continuous pulses.

4. The fixing apparatus of claim 1, wherein said intermittent pattern comprises a repeating pattern of one of:

(1) a half cycle among alternative current on one cycle;

(2) one or two half-cycles among alternative current of one and a half-cycles;

(3) one through three half-cycles among alternative current of two cycles;

(4) one through four half-cycles among alternative current of two and a half cycles;

(5) one through five half-cycles among alterative current of three cycles; and (6) two half-cycles with a same polarity among alternative current of three cycles.

5. The fixing apparatus of claim 1, wherein said heater includes a heat source having a color temperature of not more than 2600° K.

6. A fixing apparatus for an image forming apparatus, said fixing apparatus comprising:

a heater, adapted in said fixing apparatus, for heating a fixing member;

a zero-cross detector for detecting zero-cross timings of electric power when a voltage of said electric power is at zero volts;

a switching device for turning on and turning off supply of said electric power to said heater;

a direct current power supply for generating a direct current from an alternative current of said electric power;

a controller for controlling said switching device so as to provide a first state in which said electric power is continuously supplied to said heater for a multiple of half-cycles from one of said zero-cross timings, and a second state in which said electric power is prevented to be supplied to said heater for a multiple of half-cycles from another of said zero-cross timings;

wherein said electric power is supplied to said heater with an intermittent pattern, including said second state, for a predetermined period after at least one of a turn-on operation of said heater and a turn-off operation of said heater.

7. The fixing apparatus of claim 6, wherein said alternative current of said electric power, supplied to said direct current power supplying means, comprises a non-sine-wave waveform.

8. The fixing apparatus of claim 7, wherein said alternative current includes a pulse current of a peak voltage thereof.

9. The fixing apparatus of claim 6, wherein said intermittent pattern comprises a half-wave drive pattern having a fixed polarity.

10. The fixing apparatus of claim 9, wherein said half-wave drive pattern having a fixed polarity comprises a repeating pattern of one of:

(1) a half cycle among alternative current of one cycle;

(2) a half cycle among alternative current of two cycles;

(3) a half cycle among alternative current of three cycles; and (4) two half cycles having the same polarity among alternative current of three cycles.

11. The fixing apparatus of claim 6, wherein said direct current power supply includes a switching regulator, and said fixing apparatus further comprises:

a common choke for reducing noise;

wherein said common choke is provided on a line through which said alternative current is supplied to said switching regulator.

* * * * *

UNITED STATES PATENT AND TRADEMARK OFFICE

CERTIFICATE OF CORRECTION

PATENT NO. : 5,669,038

DATED : September 16, 1997

INVENTOR(S) : KISHIMOTO

It is certified that error appears in the above-identified patent and that said Letters Patent is hereby corrected as shown below:

Title page, Item [57] ABSTRACT, line 9 after "for", insert:
--a multiple of half-cycles from one of the zero-cross timings, and--;

line 11, change "one" to --another--.

Signed and Sealed this

Seventeenth Day of February, 1998

Bruce Lehman

*Attest:*

BRUCE LEHMAN

*Attesting Officer*

*Commissioner of Patents and Trademarks*